US010981720B2

(12) United States Patent
Holland et al.

(10) Patent No.: US 10,981,720 B2
(45) **Date of Patent: *Apr. 20, 2021**

(54) FABRIC CLOSURE WITH AN ACCESS OPENING FOR CARGO CONTAINERS

(71) Applicant: Advanced Composite Structures, LLC, Charleston, SC (US)

(72) Inventors: John E. Holland, Bailey, NC (US); Connie W. Holland, Bailey, NC (US); Daniel M. Nathan, Wendell, NC (US); Thomas R. Pherson, Daniel Island, SC (US)

(73) Assignee: Advanced Composite Structures, LLC, Charleston, SC (US)

( * ) Notice: Subject to any disclaimer, the term of this patent is extended or adjusted under 35 U.S.C. 154(b) by 1287 days.

This patent is subject to a terminal disclaimer.

(21) Appl. No.: 14/922,591

(22) Filed: Oct. 26, 2015

(65) Prior Publication Data

US 2016/0046441 A1 Feb. 18, 2016

Related U.S. Application Data

(63) Continuation of application No. 13/185,057, filed on Jul. 18, 2011, now Pat. No. 9,174,796, which is a (Continued)

(51) Int. Cl.
*B65D 90/02* (2019.01)
*B65D 88/12* (2006.01)
(Continued)

(52) U.S. Cl.
CPC ..... *B65D 90/021* (2013.01); *B65D 88/127* (2013.01); *B65D 88/14* (2013.01); *E06B 3/04* (2013.01); *E06B 3/80* (2013.01)

(58) Field of Classification Search
CPC ..... B65D 88/14; B65D 88/125; B65D 88/00; B65D 90/021; B65D 88/127; E06B 3/04; E06B 3/80
See application file for complete search history.

(56) References Cited

U.S. PATENT DOCUMENTS 1,557,382 A * 10/1925 Sundback ..... A44B 19/301 135/119
3,165,760 A 1/1965 Abajian
(Continued)

FOREIGN PATENT DOCUMENTS

DE 3004699 8/1980
GB 995420 6/1965
(Continued)

OTHER PUBLICATIONS

International Search Report and Written Opinion for International Application No. PCT/US2011/059671, dated Mar. 9, 2012, 9 pgs.
(Continued)

*Primary Examiner* — Anthony D Stashick
*Assistant Examiner* — Blaine G Neway
(74) *Attorney, Agent, or Firm* — Womble Bond Dickinson (US) LLP

(57) ABSTRACT

A fabric closure, and enclosure, are provided for cargo containers, including a fabric panel formed of high-strength yarns, and a pair of selectively closeable openings formed in the fabric panel for access therethrough, the selectively closeable openings having a substantially vertical opening, and a slide fastener for closure thereof.

23 Claims, 25 Drawing Sheets

Related U.S. Application Data continuation-in-part of application No. 12/946,979, filed on Nov. 16, 2010, now Pat. No. 8,479,801.

(51) Int. Cl.

| | |
|---|---|
| ***B65D 88/14*** | (2006.01) |
| ***E06B 3/04*** | (2006.01) |
| ***E06B 3/80*** | (2006.01) |

(56) References Cited

U.S. PATENT DOCUMENTS

| | | | | |
|---|---|---|---|---|
| 3,251,399 | A | | 5/1966 | Grossman |
| 3,586,013 | A | | 6/1971 | Gladden et al. |
| 3,616,838 | A | | 11/1971 | Barr |
| 3,671,542 | A | | 6/1972 | Kwolek |
| 3,951,284 | A | * | 4/1976 | Fell ..... B60P 3/00 414/812 |
| 4,031,724 | A | * | 6/1977 | Atkinson ..... A44B 19/301 70/68 |
| 4,046,186 | A | * | 9/1977 | Nordstrom ..... B60P 7/04 160/368.1 |
| 4,131,150 | A | | 12/1978 | Papadakis |
| 4,137,394 | A | | 1/1979 | Meihuizen |
| 4,221,256 | A | | 9/1980 | Karaki |
| 4,356,138 | A | | 10/1982 | Kavesh et al. |
| 4,413,110 | A | | 11/1983 | Kavesh et al. |
| 4,440,711 | A | | 4/1984 | Kwon et al. |
| 4,457,985 | A | | 7/1984 | Harpell et al. |
| 4,535,027 | A | | 8/1985 | Kobashi et al. |
| 4,538,663 | A | | 9/1985 | Looker |
| 4,599,267 | A | | 7/1986 | Kwon et al. |
| 4,600,235 | A | | 7/1986 | Frederick et al. |
| 4,601,405 | A | | 7/1986 | Riemer |
| 4,738,371 | A | | 4/1988 | Wakeman |
| 4,911,317 | A | | 3/1990 | Schloesser et al. |
| 5,183,176 | A | | 2/1993 | Meier et al. |
| 5,377,856 | A | | 1/1995 | Brierton |
| 5,395,682 | A | | 3/1995 | Holland et al. |
| 5,529,363 | A | | 6/1996 | Borowski, Jr. |
| 5,570,801 | A | * | 11/1996 | Younger ..... B65D 88/14 160/328 |
| 5,667,002 | A | | 9/1997 | Neustadt |
| 5,702,657 | A | | 12/1997 | Yoshida et al. |
| 5,819,474 | A | | 10/1998 | Strom |
| 6,113,031 | A | | 9/2000 | Williams et al. |
| 6,280,546 | B1 | | 8/2001 | Holland et al. |
| 6,701,948 | B2 | | 3/2004 | Jopp et al. |
| 6,749,076 | B2 | | 6/2004 | Fingerhut et al. |
| 6,755,232 | B1 | | 6/2004 | Holland et al. |
| 6,825,137 | B2 | | 11/2004 | Fu et al. |
| 6,962,188 | B2 | | 11/2005 | Coenraets |
| 7,195,025 | B2 | | 3/2007 | Choi et al. |
| 7,210,492 | B2 | | 5/2007 | Gerrie et al. |
| D617,522 | S | | 6/2010 | Teien |
| 7,805,897 | B2 | | 10/2010 | Holland et al. |
| 7,820,570 | B2 | | 10/2010 | Holland et al. |
| D630,815 | S | | 1/2011 | Teien |
| 8,322,955 | B2 | | 12/2012 | Arnesen et al. |
| 8,973,769 | B2 | | 3/2015 | Huber |
| D740,555 | S | | 10/2015 | Huber |
| D740,556 | S | | 10/2015 | Huber |
| 2003/0098250 | A1 | | 5/2003 | Sabounjian |
| 2005/0109382 | A1 | | 5/2005 | Choi |
| 2006/0138911 | A1 | | 6/2006 | Ransom |
| 2007/0289682 | A1 | | 12/2007 | Young |
| 2008/0102721 | A1 | | 5/2008 | Holland et al. |
| 2008/0313980 | A1 | | 12/2008 | Holland et al. |
| 2009/0183808 | A1 | | 7/2009 | Sappington et al. |
| 2015/0246749 | A1 | | 9/2015 | Huber |

FOREIGN PATENT DOCUMENTS

| | | |
|---|---|---|
| GB | 2051667 | 1/1981 |
| GB | 2349140 | 10/2000 |
| JP | 11210353 | 8/1999 |
| WO | 2008054731 | 5/2008 |
| WO | 2010088811 | 8/2010 |
| WO | 2015136043 | 9/2015 |
| WO | 2016016176 | 2/2016 |

OTHER PUBLICATIONS

International Search Report and Written Opinion for International Application No. PCT/US2012/46870, dated Oct. 5, 2012, 19 pgs.

Supreme Zipper Industries, Zipper Chain, 2010 copyright, printed from web Aug. 22, 2012, 2 pgs.

Supreme Zipper Industries, Zipper Terminology Guide, 2010 copyright, printed from web Aug. 22, 2012, 10 pgs.

English translation of DE 3004699, last viewed Jan. 12, 2016, 3 pgs.

English translation of JP 11210353, last viewed Jan. 12, 2016, 2 pgs.

Official Action U.S. Appl. No. 12/946,979, dated Sep. 4, 2012, 12 pgs.

Official Action for U.S. Appl. No. 12/946,979, dated Jan. 29, 2013, 13 pgs.

* cited by examiner

FABRIC CLOSURE WITH AN ACCESS OPENING FOR CARGO CONTAINERS

FIELD OF THE INVENTION

This application is a continuation of U.S. patent application Ser. No. 13/185,057, filed Jul. 18, 2011, which is a continuation-in-part of U.S. patent application Ser. No. 12/946,979 filed Nov. 16, 2010, now U.S. Pat. No. 8,479,801, issued Jul. 9, 2013.

FIELD OF THE INVENTION

The present invention relates to the field of transportation, and, more particularly, to cargo containers having a fabric end closure formed of high strength yarns. The closure includes a pair of access openings and functions both as a cut-resistant cargo curtain and a load retainer.

BACKGROUND OF THE INVENTION

Cargo containers of many forms have been used for transporting land, sea, and air cargo for many years. For example, one type of cargo container is box-like, with at least two side walls, a top, and a flat bottom. Another type of cargo container, commonly in use today, has opposed side walls, a flat top, and a generally rounded bottom. From the side, this type of container resembles a quadrant of a circle, and is shaped in this matter to conform to the shape of one-half of the cargo bay of cargo transport aircraft. These are commonly referred to as "Unit Load Devices" (LD1, LD3). Other types (AMT, AAY) have a rounded top and flat bottom and conform to the shape of the upper cargo bay of cargo transport aircraft. Typically, and regardless of the shape or geometry of the container, one end or side of the cargo container is open for loading and unloading cargo.

Various door closures have been used for opening and closing the open ends of such containers. One type of closure has been a rigid door closure which covers the opening to reduce tampering, to prevent the loss of small items, and to prevent the cargo from being exposed to dirt, moisture, and ultraviolet light. Another type of closures includes the combination of a webbing and a fabric closure. This type of closure has been generally preferred over rigid door closures because it tends to be much lighter and less expensive. The fabric covers have typically been formed from canvas, or vinyl coated nylon or polyester. However, each of these fabrics lacks the durability to withstand physical stresses or lacks resistance to environmental conditions or harsh chemicals common to the transportation industry. For example, exposure to ultraviolet light, diesel and jet fuels, and oils, tends to rapidly degrade such fabric covers. Accordingly, the durability of a cargo cover is ultimately determined by its tear-strength, abrasion resistance, cut-and-stab resistance and ability to withstand environmental and chemical exposure. Otherwise, the product life is very limited and replacement costs are high. Because fabric covers lack the durability to also serve as load retainers, a separate webbing or netting is often required to keep the cargo restrained so that it cannot pass through the covered end or fall out.

In more recent years, as shown in U.S. Pat. No. 5,395,682, fabric closures have been developed of a woven fabric formed of yarns of the fabric are constructed of long-chain extended (ultra-high molecular weight) polyethylene fibers. Such closures have exhibited increased strength and durability, while being considerably lighter than fabrics previously available. More specifically, as shown in U.S. Pat. No. 6,755,232, the fabric closures have been formed as a unitary panel, having web straps spaced apart and attached to the panel for releasable attachment to existing fasteners on the cargo container. In a further improvement to eliminate the need to completely remove the fabric closure from the cargo container for loading and unloading purposes, a fabric closure was developed comprising a single panels, or two panels, having an access opening for loading, unloading, and inspecting cargo, with the loosening or removal of a minimal number of straps and fasteners.

SUMMARY OF THE INVENTION

The inventors have discovered that, while having an access opening in the fabric closure facilitates less labor and time intensive requirements for loading and unloading of cargo, including such an access opening creates problems in and of itself, such as vulnerability of exposure of the cargo to contaminants and environmental elements, as well as possible penetration by cargo handling equipment are serious drawbacks.

The present invention is directed to a closure for covering the openings of cargo containers, baggage trailers, or trucks that accomplishes both of the above—described functions. Thus, the closure described hereinafter functions as both a cut—resistant cargo curtain and a load retainer for preventing cargo from falling out of the cargo container or otherwise penetrating the closure. Further, the closure described herein may be installed or removed in a fraction of the time required to install separate covers and nets or webbing and is not subject to the entanglement problems inherent in the prior art. Additionally, an easy access is provided in the unitary panel to facilitate loading, unloading, and inspection of the contents of a cargo container without having to completely remove the unitary cover.

Accordingly, one aspect of the present invention is to provide a cut resistant fabric curtain and load retainer for enclosing at least one open end or side of cargo containers having side walls, a top, and a bottom. As used here, "cargo containers" include uniform load devices (ULDs), air cargo containers, sea-land containers, over-land trailers, and the like. Also as used herein, "wall" refers to any of various upright constructions having a length much greater than the thickness and presenting a continuous surface except where pierced by doors, windows, etc. A wall may be planar or have curvature in its construction.

The fabric curtain and load retainer includes at least one panel of fabric formed of at least one layer of fabric woven with yarns formed from fibers sufficiently cut and tear resistant to prevent cargo from penetrating the curtain. The fabric is desirably also resistant to heat, cold, ultraviolet (UV) radiation, and chemicals such as diesel and jet fuels and oils. Two high strength yarns formed from long chain polyethylene fibers are available from Honeywell under the trademark SPECTRA® or from DSM under the trademark DYNEEMA®. The term "high strength yarns" means yarns formed from fibers having a tenacity exceeding 7 grams/denier and initial tensile moduli of at least about 150 g/d. Other suitable high-strength yarns having the characteristics described above also may include ultra high molecular weight aramids, and ultra high molecular weight polypropylene, liquid crystal polymers (Vertran), PBO, and those formed of blends of such compositions. Aramids are intended also to include para-aramids such as KEVLAR® by DuPont. The fabric may further be coated or laminated with a thermoplastic film.

The fabric closure is formed so that it substantially covers the open end of the cargo container. Preferably, at least some portion overlaps the peripheral edges of the cargo container side walls and top. The overlap portion provides an additional barrier to environmental or other anticipated undesirable elements, and this barrier may be further enhanced by securing the overlap portion around the periphery of the cargo container with a cable or the like that is inserted through a hem formed in the edge of the overlap portion and fastened to the lower front corners of the container. Alternatively, the fabric closure may be secured around the periphery of the open end of the cargo container with riveted fasteners, as such fasteners are well known in the art.

Once the fabric closure has been secured around the periphery of the cargo container, it must be drawn taut to restrain cargo stowed in the container. One way of tensioning the fabric panel is by means of web straps and fasteners that are attached around at least part of the periphery of the fabric closure. For example, it may be desirable to attach the fabric cover along one side and along either the top or bottom of the cargo container with hooks that are attached to the outer edges of the fabric. Adjustable fasteners attached along the opposite side and top or bottom of the fabric closure may then serve the dual function of attaching the fabric closure to those sides of the cargo container as well as drawing the fabric taut, thereby restraining cargo stowed in the cargo container, while preventing items of cargo from slipping around or through the fabric closure. Preferably, the fabric closure is constructed so that opposed pairs of web straps are attached around the periphery of the fabric panel. The term "opposed pair" means that each strap of a pair is positioned at a point on the opposite side of the panel from the other so that the pair form a "load path". The straps are located to correspond with fasteners attached to the cargo container around the open end thereof. Again, each pair should include one member that is adjustable so that the cover can be made taut. When the strap pairs are attached co-linearly to a high-strength fabric panel such as that described herein, the straps and fabric combination provide load restraint at least equivalent to separately formed webbing or nets. The straps are formed of nylon, but any suitable high strength webbing material may be used. The term "high strength webbing" material means webbing having a tear strength of about 900 pounds or more per linear inch of webbing width. Desirably the straps are sewn to the fabric panel with a high strength thread such as SPECTRA® or DYNEEMA®. The web straps are secured to fasteners, such as hooks and buckles, for securing the top and opposed bottom portions of the fabric panel to the cargo container.

A selectively closeable opening is formed in the fabric panel for access therethrough, and includes at least a vertical opening and sometimes a horizontal opening. A slide fastener is attached along adjacent edges of the length of the vertical opening and the horizontal opening, wherein the fabric panel prevents passage of cargo items which may be stowed in the container around and through the fabric closure.

In some embodiments, the fabric closure further includes web closure straps that are attached adjacent to and on both sides of the substantially vertical opening, the web closure straps having attached fasteners for further securing together both sides of the substantially vertical opening and insuring stability of the load contained therein. The slide fastener, or zipper, attached along the substantially vertical opening may include a tab that is moveable to open from the bottom upwardly and to close from the top downwardly. A flap may be provided to extend along the substantially vertical opening, the substantially horizontal opening, or both to overly and protect the slide fasteners from contamination and exposure to the elements.

In some embodiments the vertical opening terminates at a point near, but not all the way at the top. In other embodiments, the fabric panel extends entirely from the bottom to the top, in which case the panel is essentially formed of two sections joined along adjacent edges where closed. In some embodiments, the horizontal opening intersects the vertical opening to create a T-shaped selectively closeable opening. Alternatively, the horizontal opening may extend from a point spaced apart from one of the opposed side edges of the fabric panel and terminates at the intersection with the vertical opening, to form an inverted L-shape.

In yet other embodiments, while the fabric panel is formed of the same type of high strength yarns and preferably coated with a polymeric (thermoplastic or thermosetting) film, the access opening in the fabric panel is enlarged and formed by a pair of spaced vertical openings in the fabric panel. The openings extend from the bottom to a point near the top, and are selectively closed by slide fasteners. When opened, the fabric panel may be folded up and out of the way providing greater and easier access to the interior. This aspect may be incorporated in the box-like cargo container, in ULD's (whether the lower deck type or the main deck type) to afford lighter weight covers, but yet covers that provide greater, but secure, access.

These and other aspects of the present invention will become apparent to those skilled in the art after a reading of the following description of the preferred embodiment when considered with the drawings.

DETAILED DESCRIPTION

Figure 1:
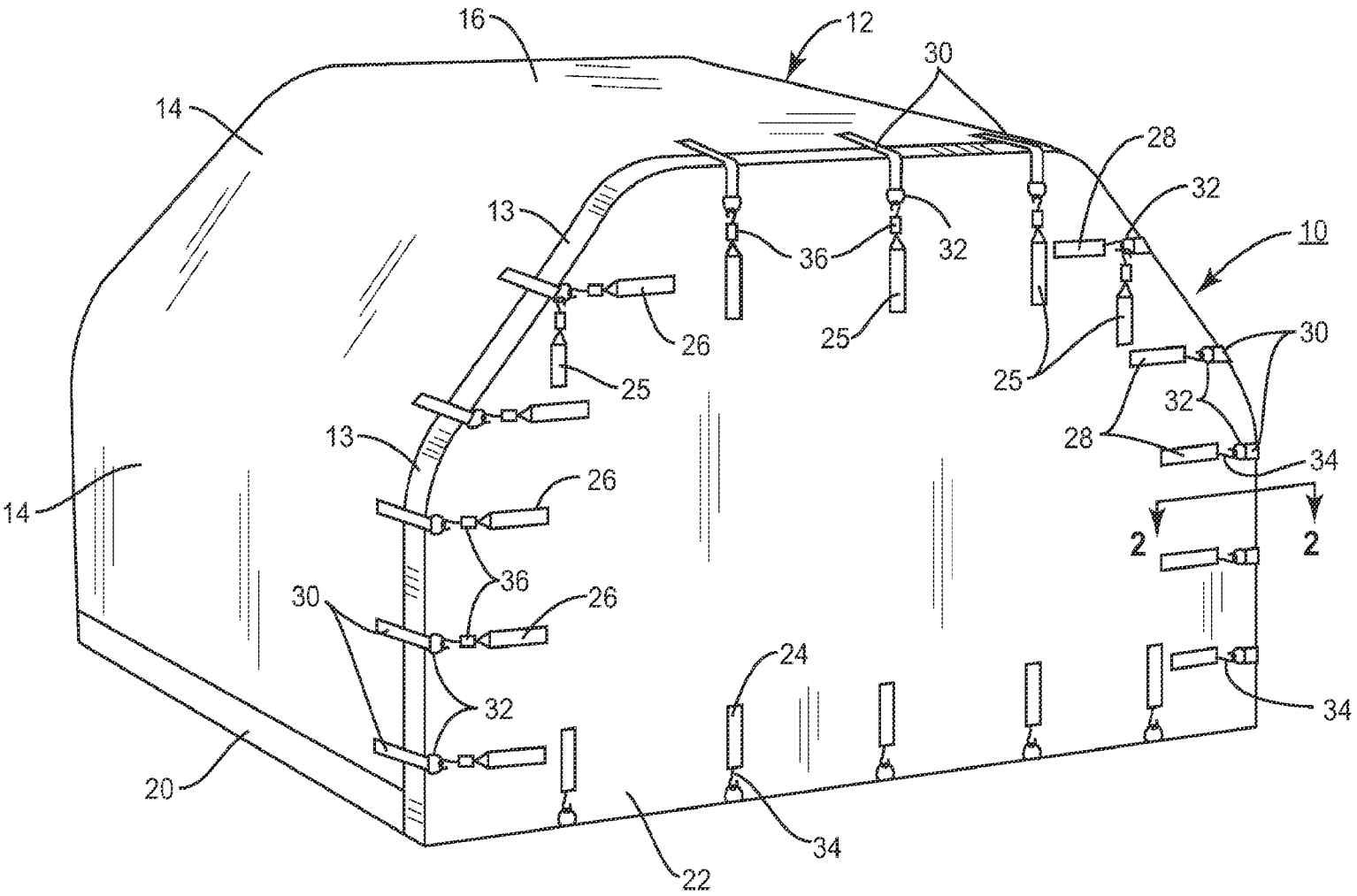
FIG. 1 PRIOR ART
FIG. 1 is a schematic environmental view of a prior art closure for a cargo container.

Referring now to the drawings in general and to FIGS. 1 through 3D in particular, and by way of background for the present invention, it will be understood that the illustrations are for the purpose of describing known fabric enclosures for open end cargo containers.

As best seen in FIG. 1, a unitary fabric closure that combines the functions of a separate cut-resistant fabric, and of a webbing, is depicted generally as 10. Closure or closure member 10 is used in conjunction with a cargo container 12, having side walls 14, a top wall 16, and a bottom 20. While the cargo container 12 shown in FIG. 1 has a dome-shaped top wall 16, it will be appreciated by those skilled in the art that cargo containers 12 are manufactured in various shapes and sizes. Accordingly, side walls 14, top wall 16, and bottom 20 may vary.

Closure member 10 is formed from at least one panel 22 with at least one layer of a fabric woven with high strength yarns formed substantially from high tenacity fibers sufficiently cut resistant to prevent penetration by cargo, or cargo handling equipment. While minor amounts of other fibers (less than 50%) might be blended herewith, the yarns should be primarily from yarns having a tenacity of at least 20 grams/denier.

As used herein, the term "high tenacity fibers" means fibers which have tenacities equal to or greater than about 7 g/d. Preferably, these fibers have initial tensile moduli of at least about 150 g/d and energies-to-break of at least about 8 J/g as measured by ASTM D2256. As used herein, the terms "initial tensile modulus", "tensile modulus" and "modulus" mean the modulus of elasticity as measured by ASTM 2256 for a yarn and by ASTM D638 for an elastomer or matrix material.

Preferably, the high tenacity fibers have tenacities equal to or greater than about 10 g/d, more preferably equal to or greater than about 15 g/d, even more preferably equal to or greater than about 20 g/d, and most preferably equal to or greater than about 25 g/d.

The yarns and fabrics of the invention may be comprised of one or more different high strength fibers. The yarns may be in essentially parallel alignment, or the yarns may be twisted, over-wrapped or entangled. The fabrics of the invention may be woven with yarns having different fibers in the warp and weft directions, or in other directions. The fabrics may also be found by sheets of non-woven fibers laminated together.

The cross-sections of fibers useful herein may vary widely. They may be circular, flat or oblong in cross-section. They may also be of irregular or regular multi-lobal cross-section having one or more regular or irregular lobes projecting from the linear or longitudinal axis of the fibers. It is preferred that the fibers be of substantially circular, flat or oblong cross-section, most preferably substantially circular.

High tenacity fibers useful in the yarns and fabrics of the invention include highly oriented high molecular weight polyolefin fibers, particularly high modulus polyethylene fibers, aramid fibers, polybenzoxazole fibers such as polybenzoxazole (PBO) and polybenzothiazole (PBT), polyvinyl alcohol fibers, polyacrylonitrile fibers, liquid crystal copolyester fibers, basalt or other mineral fibers, as well as rigid rod polymer fibers, and mixtures and blends thereof. Preferred high strength fibers useful in this invention include polyolefin fibers, aramid fibers and polybenzoxazole fibers, and mixtures and blends thereof. Most preferred are high modulus polyethylene fibers, aramid fibers and polybenzoxazole fibers, and blends and mixtures thereof. The yarns may comprise a single type of fiber or blends of two or more fibers. Additionally, different fibers may be employed in the fiber network.

U.S. Pat. No. 4,457,985 generally discusses such high molecular weight polyethylene and polypropylene fibers, and the disclosure of this patent is hereby incorporated by reference to the extent that it is not inconsistent herewith. In the case of polyethylene, suitable fibers are those of weight average molecular weight of at least about 150,000, preferably at least about one million and more preferably between about two million and about five million. Such high molecular weight polyethylene fibers may be spun in solution (see U.S. Pat. Nos. 4,137,394 and 4,356,138), or a filament spun from a solution to form a gel structure (see U.S. Pat. No. 4,413,110, German Off. No. 3,004, 699 and GB Patent No. 2051667), or the polyethylene fibers may be produced by a rolling and drawing process (see U.S. Pat. No. 5,702,657). As used herein, the term polyethylene means a predominantly linear polyethylene material that may contain minor amounts of chain branching or comonomers not exceeding about 5 modifying units per 100 main chain carbon atoms, and that may also contain admixed therewith not more than about 50 wt % of one or more polymeric additives such as alkene-1-polymers, in particular low density polyethylene, polypropylene or polybutylene, copolymers containing mono-olefins as primary monomers, oxidized polyolefins, graft polyolefin copolymers and polyoxymethylenes, or low molecular weight additives such as antioxidants, lubricants, ultraviolet screening agents, colorants and the like which are commonly incorporated.

High tenacity polyethylene fibers (also referred to as extended chain or high modulus polyethylene fibers) are preferred and are sold under the trademark SPECTRA® by Honeywell International Inc. of Morristown, N.J., U.S.A.

Depending upon the formation technique, the draw ratio and temperatures, and other conditions, a variety of properties can be imparted to these fibers. The tenacity of the fibers are at least about 7 g/d, preferably at least about 15 g/d, more preferably at least about 20 g/d and most preferably at least about 25 g/d. Similarly, the initial tensile modulus of the fibers, as measured by an Instron tensile testing machine, is preferably at least about 300 g/d, more preferably at least about 500 g/d, still more preferably at least about 1,000 g/d and most preferably at least about 1,200 g/d. These highest values for initial tensile modulus and tenacity are generally obtainable only by employing solution grown or gel spinning processes. Many of the filaments have melting points higher than the melting point of the polymer from which they were formed. Thus, for example, high molecular weight polyethylene of about 150,000, preferably about one million and more preferably about two million molecular weight generally have melting points, in the bulk of 138° C. The highly oriented polyethylene filaments made of these materials have melting points of from about 7° C. to about 13° C. higher. Thus, a slight increase in melting point reflects the crystalline perfection and higher crystalline orientation of the filaments as compared to the bulk polymer.

Similarly, highly oriented high molecular weight polypropylene fibers of weight average molecular weight at least about 200,000, preferably at least about one million and more preferably at least about two million may be used. Such extended chain polypropylene may be formed into reasonably well oriented filaments by the techniques prescribed in the various references referred to above, and especially by the technique of U.S. Pat. No. 4,413,110. Since polypropylene is a much less crystalline material than polyethylene and contains pendant methyl groups, tenacity values achievable with polypropylene are generally substantially lower than the corresponding values for polyethylene. Accordingly, a suitable tenacity is preferably at least about 8 g/d, more preferably at least about 11 g/d. The initial tensile modulus for polypropylene is preferably at least about 160 g/d, more preferably at least about 200 g/d. The melting point of the polypropylene is generally raised several degrees by the orientation process, such that the polypropylene filament preferably has a main melting point of at least 168° C., more preferably at least 170° C. The particularly [referred ranges for the above described parameters can advantageously provide improved performance in the final article. Employing fibers having a weight average molecular weight of at least about 200,000 coupled with the preferred ranges for the above-described parameters (modulus and tenacity) can provide advantageously improved performance in the final article.

In the case of aramid fibers, suitable fibers formed from aromatic polyamides are described in U.S. Pat. No. 3,671,542, which is incorporated herein by reference to the extent not inconsistent herewith. Preferred aramid fibers will have a tenacity of at least about 20 g/d, an initial tensile modulus of at least about 400 g/d and an energy-to-break at least about 8 J/g, and particularly preferred aramid fibers will have a tenacity of at least about 20 g/d and an energy-to-break of at least about 20 J/g. Most preferred aramid fibers will have a tenacity of at least about 20 g/d, a modulus of at least about 900 g/d and an energy-to-break of at least about 30 J/g. For example, polyp-phenylene terephthalamide) filaments which have moderately high moduli and tenacity values are particularly useful in forming ballistic resistant composites. Examples are Kevlar® 29 which has 500 g/d and 22 g/d and Kevlar® 49 which has 1000 g/d and 22 g/d as values of initial tensile modulus and tenacity, respectively. Examples are Twaron® T2000 from Teijin which has a denier of 1000. Other examples are Kevlar® 29 which has 500 g/d and 22 g/d as values of initial tensile modulus and tenacity, respectively, as well as Kevlar® 129 and KM2 which are available in 400, 640 and 840 deniers from du Pont. Aramid fibers from other manufacturers can also be used in this invention. Copolymers of poly(p-phenylene terephthalamide) may also be used, such as co-poly(p-phenylene terephthalamide3,4' oxydiphenylene terephthalamide). Also useful in the practice of this invention are poly(m-phenylene isophthalamide) fibers sold by du Pont under the trade name Nomex®.

High molecular weight polyvinyl alcohol (PV—OH) fibers having high tensile modulus are described in U.S. Pat. No. 4,440,711 to Kwon et al., which is hereby incorporated by reference to the extent it is not inconsistent herewith. High molecular weight PV—OH fibers should have a weight average molecular weight of at least about 200,000. Particularly useful PV—OH fibers should have a modulus of at least about 300 g/d, a tenacity preferably at least about 10 g/d, more preferably at least about 14 g/d and most preferably at least about 17 g/d, and an energy to break of at least about 8 J/g. PV—OH fiber having such properties can be produced, for example, by the process disclosed in U.S. Pat. No. 4,599,267.

In the case of polyacrylonitrile (PAN), the PAN fiber should have a weight average molecular weight of at least about 400,000. Particularly useful PAN fiber should have a tenacity of preferably at least about 10 g/d and an energy to break of at least about 8 J/g. PAN fiber having a molecular weight of at least about 400,000, a tenacity of at least about 15 to 20 g/d and an energy to break of at least about 8 J/g is most useful; and such fibers are disclosed, for example, in U.S. Pat. No 4,535,027.

One preferred material is a woven fabric formed from SPECTRA® ultra high molecular weight polyethylene fibers. In one embodiment, the fabric preferably has between about 15 and about 45 ends per inch (about 5.9 to about 17.7 ends per cm) in both the warp and fill directions, and more preferably between about 17 and about 33 ends per inch (about 6.7 to about 13 ends per cm). The yarns are preferably each between about 650 and about 1200 denier. The result is a woven fabric weighing preferably between about 2 and about 15 ounces per square yard (about 67.8 to about 508.6 g/m$^2$), and more preferably between about 5 and about 11 ounces per square yard (about 169.5 to about 373.0 g/m$^2$). The following table provides fabric constructions that are suitable for use in the present invention, As those skilled in the art will appreciate, the fabric constructions described here are exemplary only and not intended to limit the invention thereto. Each of these uncoated fabrics is available from Hexcel of Anderson, S.C., and is made from SPECTRA.® fiber:

| Style | Weave | Weight (Oz/Yd$^2$) | Thickness (Inches) | Counts (Ends/Inch) | Yarn Denier (Warp/Fill) |
|---|---|---|---|---|---|
| 902 | Plain | 5.5 | 0.018 | 17 × 17 | 1200/1200 |
| 904 | Plain | 6.3 | 0.017 | 34 × 34 | 650/650 |
| 952 | Plain | 6.0 | 0.017 | 34 × 34 | 650/650 |

As shown in the table, a plain weave fabric having 17 ends per inch of 1200 denier SPECTRA® 900 fiber in both the warp and fill directions weighs only about 5.5 ounces per square yard (about 186.5 g/m$^2$), but has a breaking strength of greater than 800 pounds force per inch (1401 N/cm) in both directions. Other weaves than a plain weave may be employed, such as a basket weave.

The fabric should further be coated or laminated with a thermoplastic film, to provide additional protection from the elements, including waterproofing. As used herein, the terms "coated" and "laminated" may be used interchangeably to describe one or more protective layers applied to a fabric substrate. Exemplary coated fabrics for providing such protection are described in U.S. Pat. Nos. 6,280,546 and 7,820,570, the contents of which are incorporated herein in their entirety. This coated fabric includes: (a) a fabric in which high performance yarns are a major constituent and have a denier between about 360 and 1,200; (b) a thermoplastic film bonded to at least one side of the fabric. The thermoplastic film comprising ethylene vinyl acetate, or low density polyethylene, or a combination of the two.

Also the fabric for the closure member 10 could be a sandwich non-woven sheets laminated together. For example SPECTRA® ultra high molecular weight fibers coated with a low melting thermoplastic, such as SBS/SIS copolymer can be formed into thin (0.005") plies. The plies can be laminated together in various orientations (0/90 degrees for example) using heat and pressure. The plied fabric sheet can then be coated with polymeric films.

Figure 2:
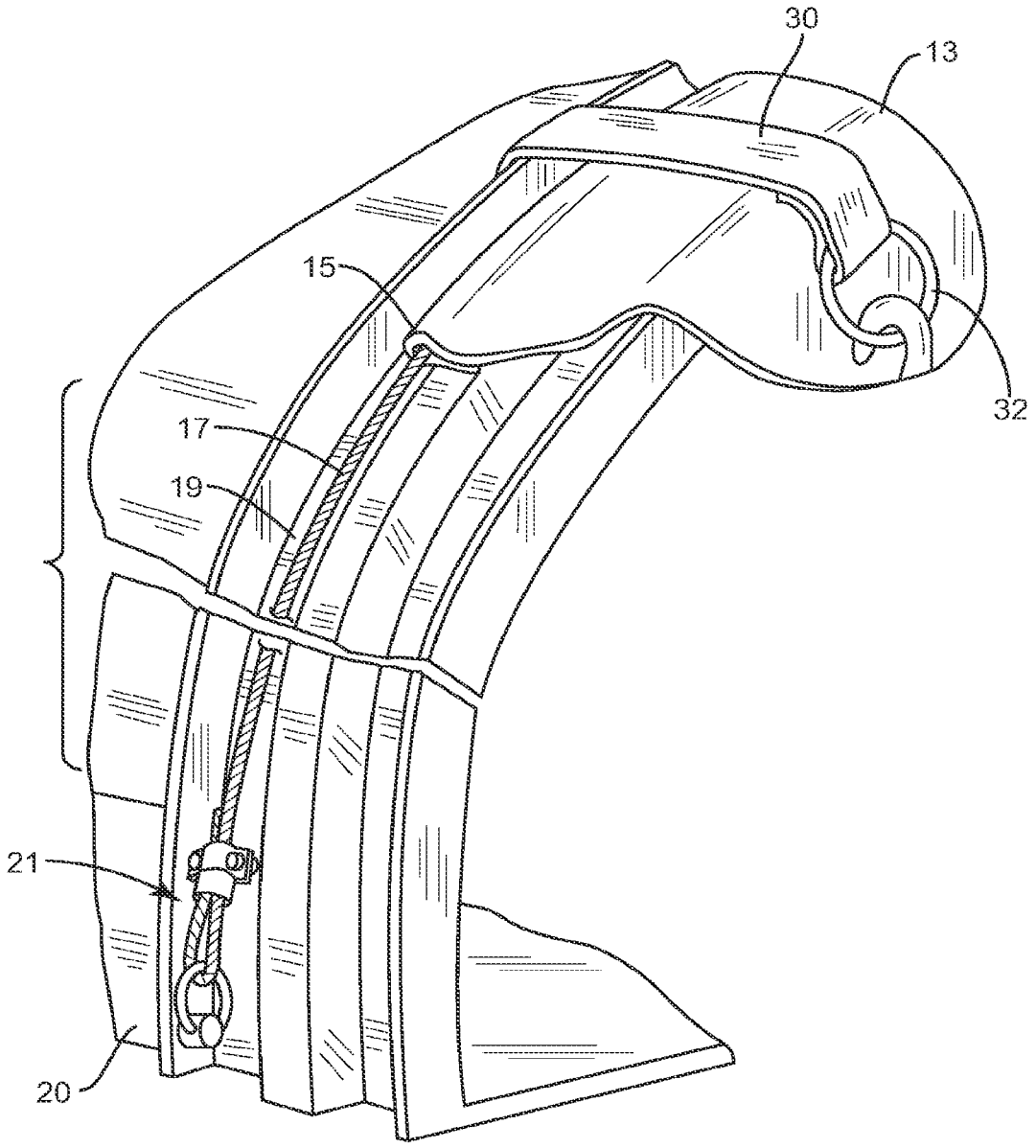
FIG. 2 PRIOR ART
FIG. 2 is a front perspective view illustrating how the closure of FIG. 1 is secured around the periphery of the cargo container with a cable.
Figure 8:
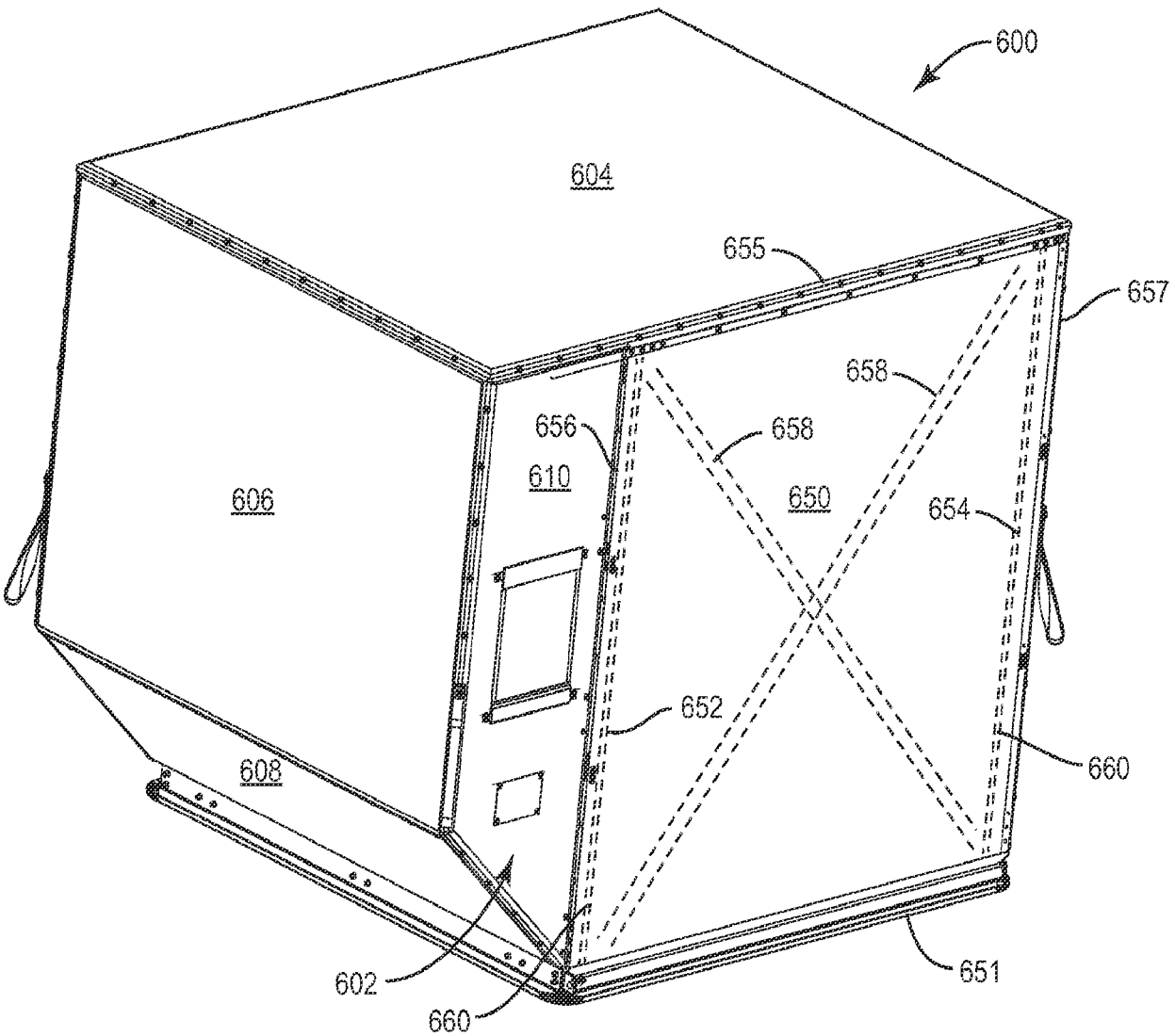
FIG. 8 is a front perspective view of yet another alternative closure constructed for an air cargo container currently being used for larger aircraft.

FIGS. 1-3D are exemplary of prior art cover members for cargo containers. Panel 22 is sized to completely cover the open end of cargo container 12 and to overlap the side and top edges of container 12 with an edge portion 13. Edge portion 13 provides an additional barrier to environmental or other anticipated undesirable elements. As shown in FIG. 2, a hem 15 may be formed in the outer edge of portion 13 for insertion therethrough by a cable 17. Edge portion 13 may then be secured around the periphery of container 12 by fastening opposite ends of cable 17 with clamps 21, or other suitable fasteners. Once secured with clamps 21, cable 17 provides a seal by snugly holding edge portion 13 in a channel 19, such a channel 19 being conventional for cargo containers. Alternatively, and as shown in the embodiment of FIG. 8 described below, the edge portions 13, of the fabric closure, with hems 15 as needed, may be secured around the periphery of the open end of the cargo container with riveted fasteners, as such fasteners are well known in the art.

As shown in FIG. 1, a plurality of opposed web strap pairs 24 and 25 are attached to the top and bottom portions of panel 22 in such fashion and alignment as to provide the same structural arrangement, or "load path," that a series of continuous web straps might have if attached separately. That is, the combination of a high strength fabric closure with web straps attached thereto along a common axis, forms at least the equivalent restraining force as continuous straps.

Similarly, opposed web strap pairs 26 and 28 are attached to opposing side portions of panel 22. Web straps 24, 25, 26, and 28 are formed from nylon, but other high strength webbing materials may be substituted. The term "high strength webbing" material means webbing having a tear strength of about 900 pounds or more per linear inch of webbing width. Straps 24, 25, 26, and 28 are desirably sewn to panel 22 with high strength threads such as SPECTRA®, or DYNEEMA®, available from DSM.

Figure 3B:
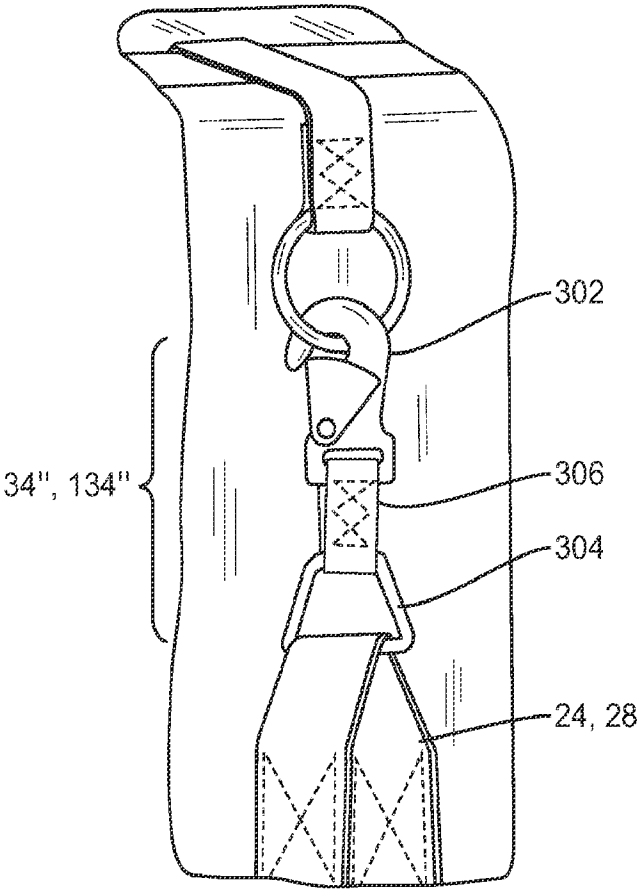
FIG. 3B PRIOR ART
FIG. 3B is a perspective view of a snap hook assembly-type fastener for securing the closure to a cargo container.
Figure 3A:
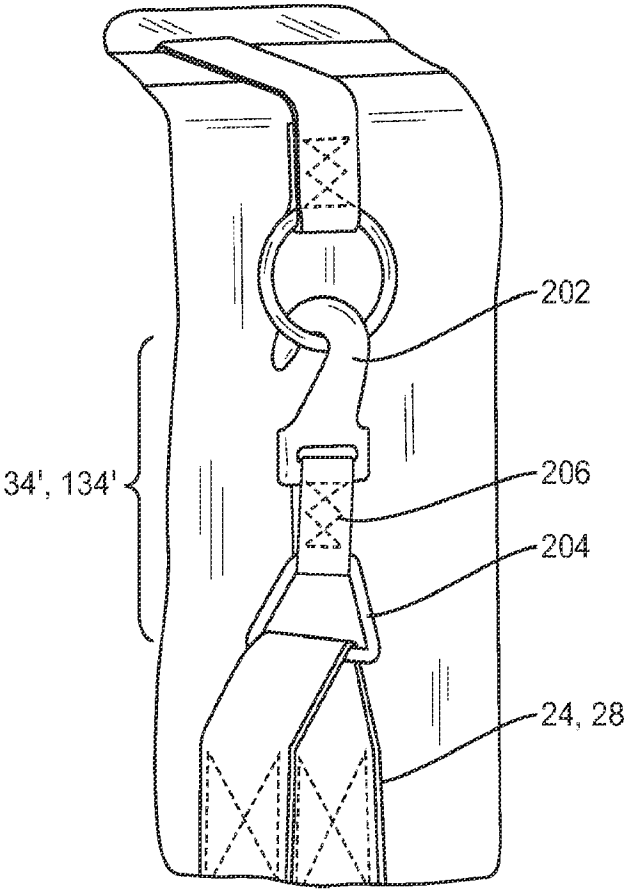
FIG. 3A PRIOR ART
FIG. 3A is a perspective view of a hook assembly-type fastener for securing the prior art closure to a cargo container.

As is standard in the transportation industry, some cargo container constructions 12 are already normally supplied with a plurality of straps with rings 32 affixed to the cargo container 12 for attaching web straps or separate webbing thereto. Web straps 24, 25, 26, and 28 are aligned to correspond with straps with rings 32 for convenient attachment thereto. A variety of fastener types are commercially available for attachment to the web straps. As shown in FIG. 1, fasteners 34 and 36 are attached to each of the web strap pairs 24, 25, and 26, 28. FIGS. 3A and 3B illustrate two types of fasteners 34' and 34" that are suitable for such attachment, although the choice of fasteners is dependent upon the specific container 12, government regulations regarding transportation of specific containers, and the particular application. While fastener 34' is a simpler construction, 34" provides an additional measure of attachment. FIG. 3A shows fastener 34' as a simple hook assembly comprised of a hook 202 attached to a ring 204 with a strap portion 206. Fastener 34' is attached to panel 22 with strap 24 or 28. Hook 202 mates with ring 32 that is connected to cargo container 12 with strap 30. Strap portion 206, as well as strap portions 306, 406, and 506 shown in FIGS. 3A through 3D are designed as "sacrificial loops." That is, should hook 202 require replacement, strap portion 206 may be cut to enable such replacement. A new strap portion 206 may then be looped and sewn to connect a new hook 202 to ring 204 without the need for the timely and costly replacement or alteration of straps 24 or 28, attached to panel 22.

Figure 3C:
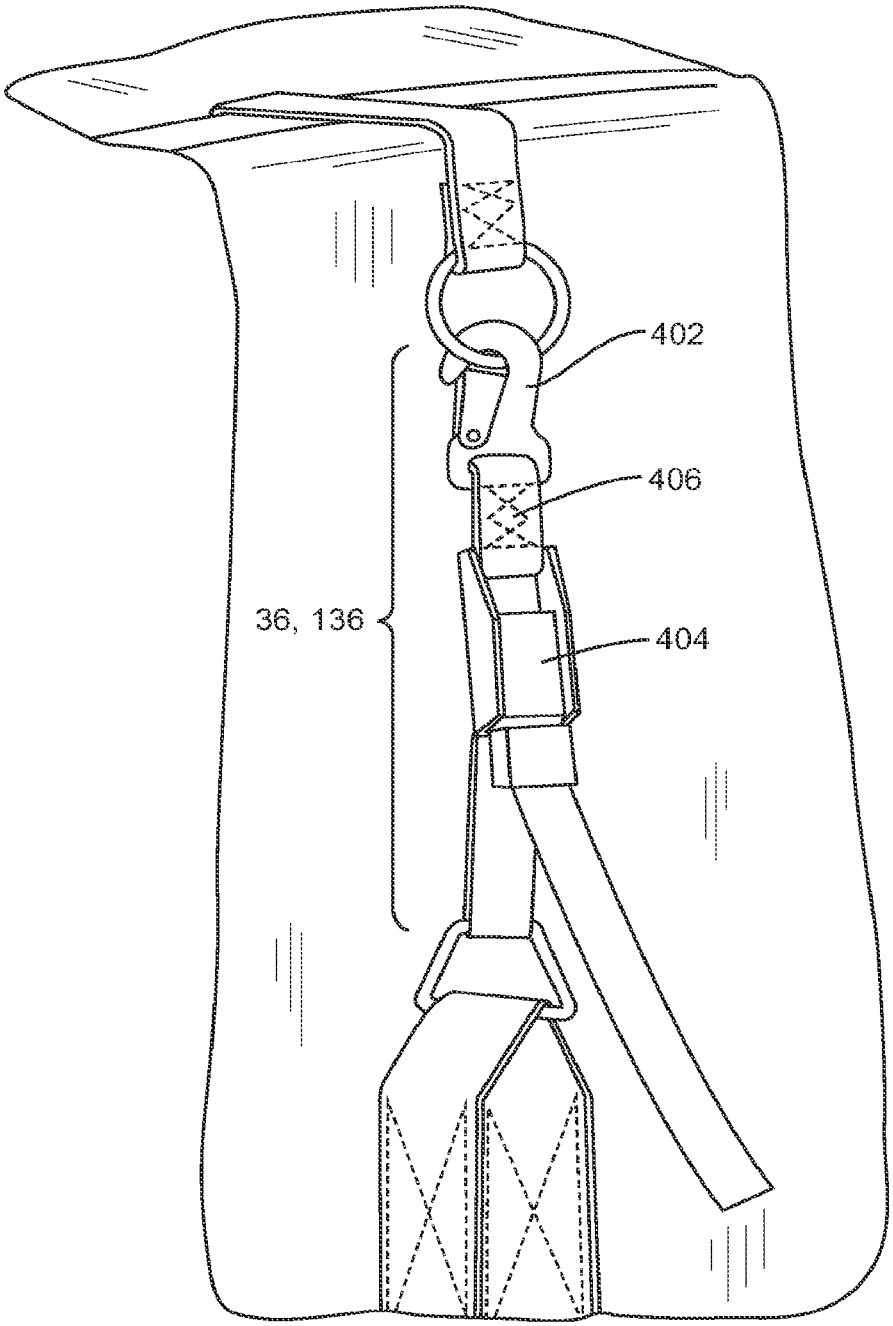
FIG. 3C PRIOR ART
FIG. 3C is a perspective view of an adjustable snap hook assembly-type fastener for making the prior art closure taut.

Similarly, FIG. 3B illustrates an alternative fastener 34", a snap-hook assembly comprised of a snap hook 302 attached to a ring 304 with a strap portion 306. Fastener 34" is attached to panel 22 with strap 24 or 28. Snap-hook 302 mates with ring 32 connected to cargo container 12 via strap 30. The fasteners shown in FIGS. 3A and 3B are but two possible fasteners that may be used from the wide variety of available fasteners. Fasteners 34 may be simple hooks, snap hooks, or other fasteners suitable for mating with rings 32. Since fasteners 34 are non-adjustable, desirably fasteners 36 are adjustable for taking up the slack in panel 22 and providing additional load restraint for the cargo stowed in container 12. FIG. 3C illustrates one possible adjustable fastener 36, 136 suitable for such purpose, comprised of a snap-hook 402 connected to an adjustable buckle 404 with a strap portion 406. The adjustable buckle 404 attaches strap portion 406 to ring 410. Ring 410 attaches to strap 25, 26, thereby securing fastener 36, 136 to panel 22. Fastener 36, 136 is attached to panel 22 with straps and 26.

Figure 4:
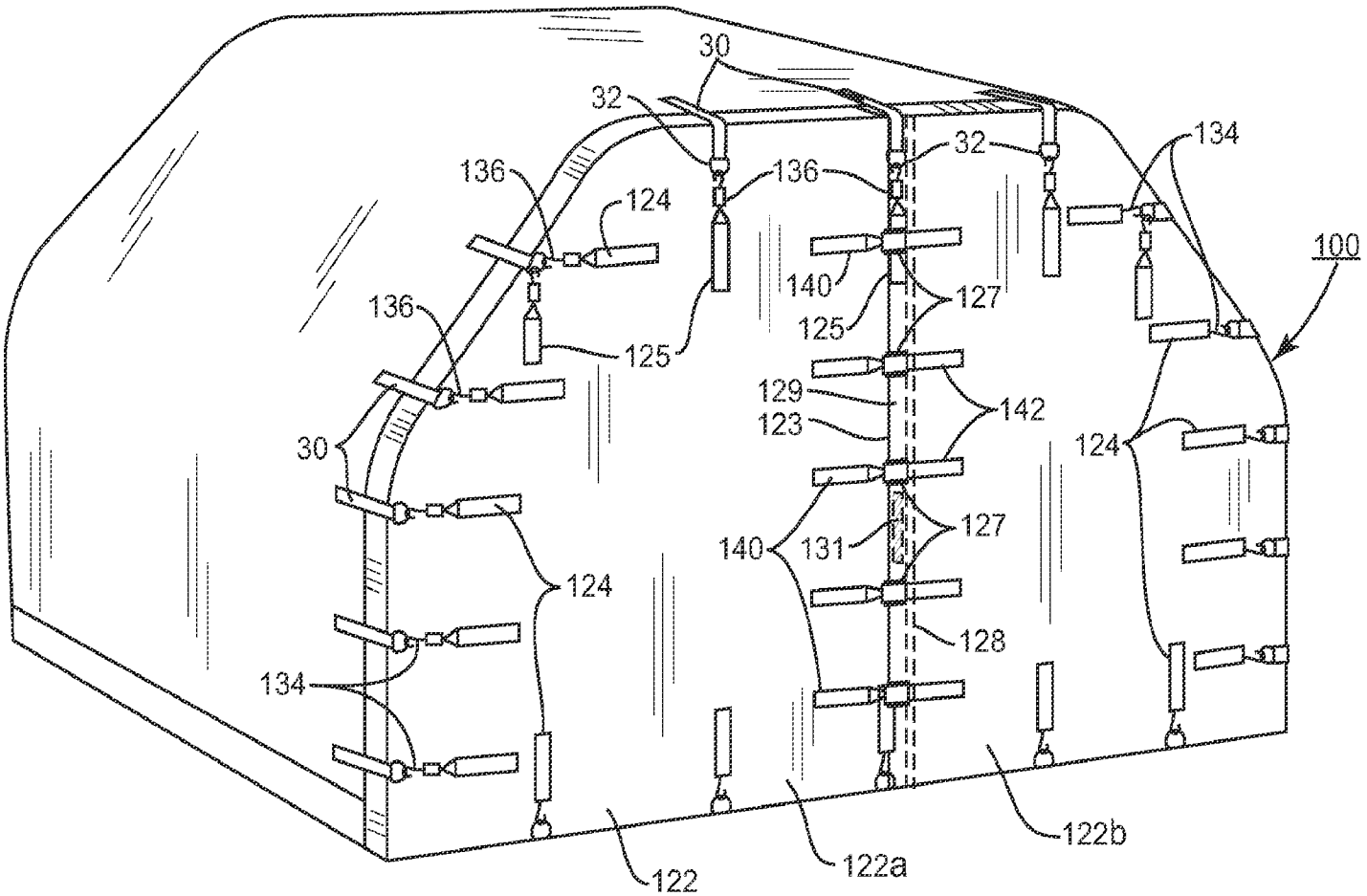
FIG. 4 is a schematic environmental view of the closure of FIG. 1 with an access opening formed in the closure according to one aspect of the present invention.

As shown in FIG. 4, a first aspect of the present invention, designated 100, includes a panel 122 formed from the same material as panel 22 and with a substantially vertical opening 123 extending substantially the length of panel 122. Opening 123 comprises two separate portions or sides, shown in FIG. 4 as 122*a* and 122*b*. Non-adjustable web straps 124 and fasteners 134 are attached to adjacent edges of panels 122*a* and 122*b*. A slide fastener, or zipper, 128 is attached along the adjacent edges of substantially the entire length of the vertical opening 123. As used herein, the terms "slide fastener" and "zipper" refer to a device used for fastening materials, and comprising two toothed tracks or spiral metal or plastic coils, each bordering one of the two edges to be joined, and having a piece that either interlocks or separates the two edges when pulled. As will be appreciated, the slide fastener 128 that is attached along the vertical opening 123 separates from the bottom edge of the panel 122 upwardly, and interlocks from the top edge of the vertical opening 123 downwardly. Suitable slide fasteners should be at least about 10 gauge, as "gauge" is commonly measured in the art, to provide the heavy-duty load restraint needed. One suitable slide fastener type is a heavy-duty molded plastic zipper (resists corrosive effects of salt and seawater) such as the No. 15 Big Zip, available from Lenzip Manufacturing Corporation of Rolling Meadows, Ill., as Part No. 1540E. As will be appreciated, depending upon the loading and unloading preferences of the cargo carrier, the zippers used may be either Open Top, Closed Bottom (in which the two tracks do not completely separate when the zipper is opened), or Open Top, Open Bottom (in which the two tracks do completely separate when the zipper is opened).

Optionally, to protect the slide fastener from contamination and exposure from the elements, a flap 129 may be affixed to the panel 122*b* by sewing, adhering, etc. to extend along the length of the vertical opening 123, the flap having one edge attached to the fabric panel and an opposed free edge overlying the slide fastener 128. To further protect the slide fastener 128 from contaminants and environmental exposure, the flap 129 may be secured to panel 122*a* with a hook and look fastener, such as VELCRO® 131.

Figure 3D:
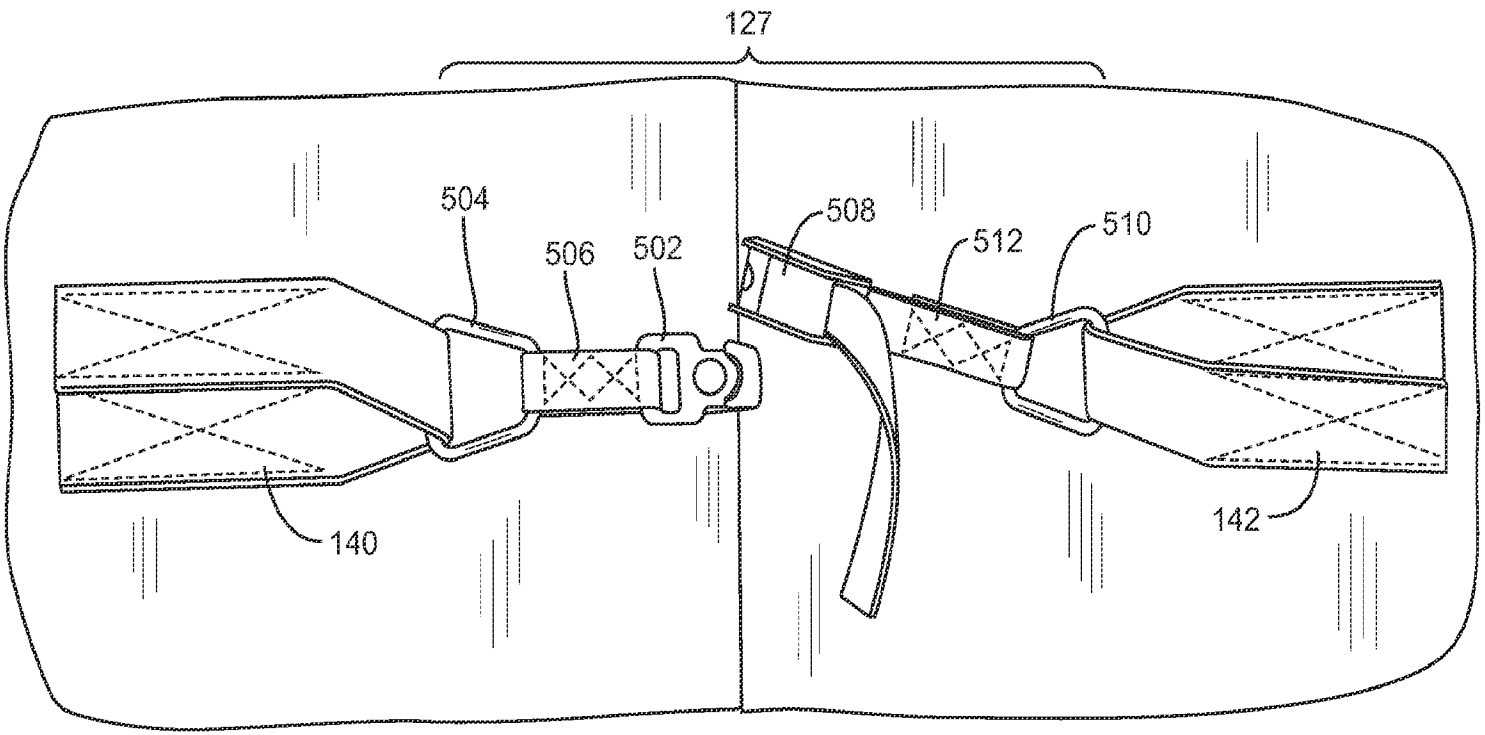
FIG. 3D PRIOR ART
FIG. 3D is a perspective view of a flat hook and cam buckle assembly for securing the opening in the panel.

Web strap pairs 140 and 142 are connected with adjustable fasteners 127 to secure opening 123 for transit. Adjustable fasteners 127 function to take-up the slack in panels 122*a*, 122*b* in the horizontal direction, while also providing additional load restraint for the cargo in container 12. FIG. 3D illustrates one adjustable fastener 127 that preferably is used. Fastener 127 is comprised of flat hook 502 connected to ring 504 with strap portion 506. Ring 504 is attached with web strap 140 to panel section 122*a*. Hook 502 mates with adjustable cam buckle 508 that is connected to ring 510 with strap portion 512. Ring 510 is attached with strap 142 to panel section 122*b*. Non-adjustable straps 124 with fasteners 134, such as those fasteners shown in FIGS. 3A and 3B, are attached along the bottom and side portions of panels 122*a* and 122*b*, and straps 125 with adjustable fasteners 136 are attached along the top portion of panels 122*a* and 122*b*. Adjustable fasteners 136, such as that shown in FIG. 3C, function to take-up slack in the vertical direction and apply additional load restraint for the cargo in container 12.

Figure 5:
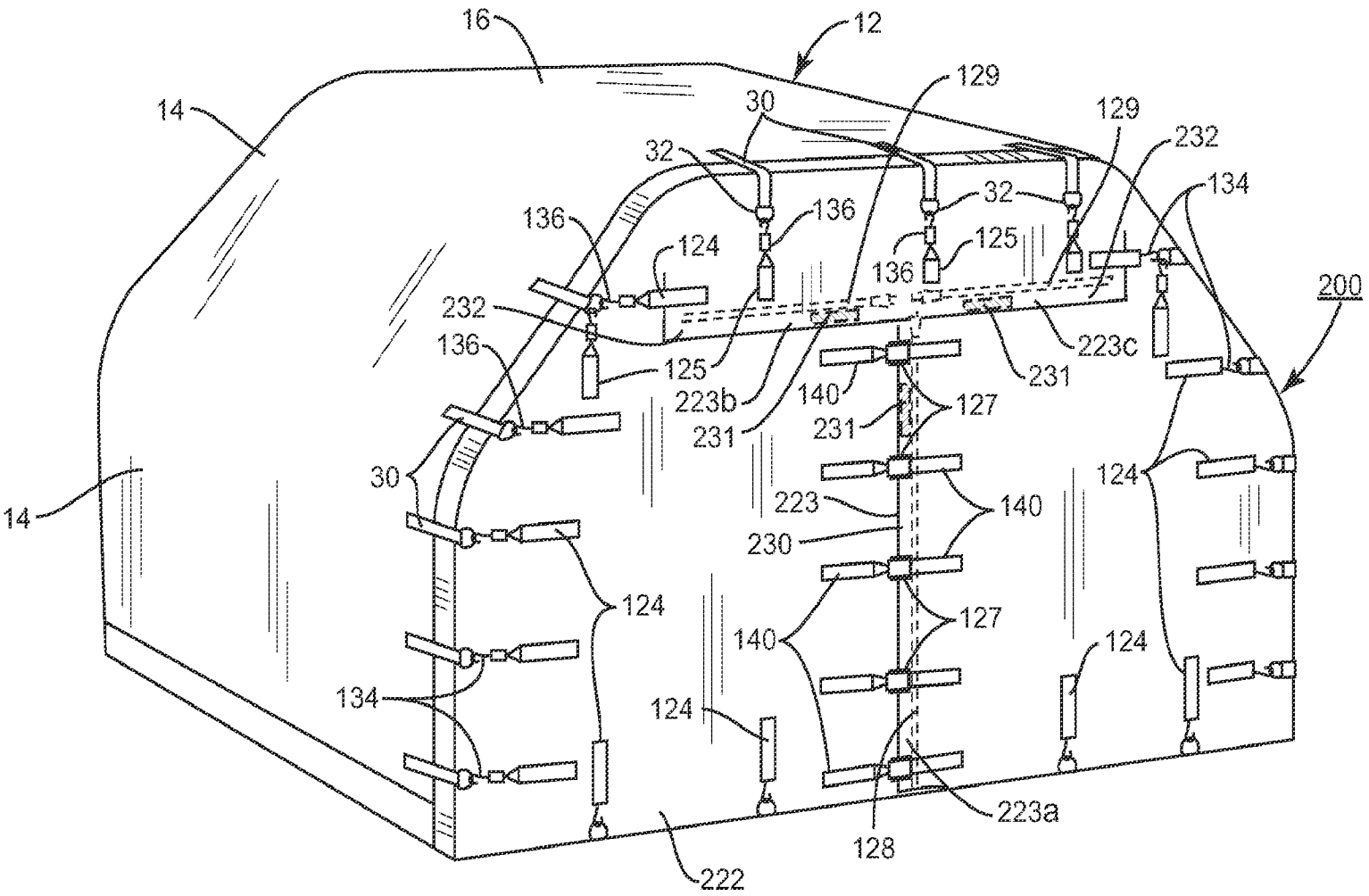
FIG. 5 is a front perspective view of a closure constructed according to another aspect of the present invention for a cargo container.

Turning now to FIG. 5, another aspect of the present invention is directed to a fabric closure 200 for a cargo container 12 of the type described above. As shown in FIG. 5, and as described in greater detail below, the fabric closure 200 of the present invention includes a panel 222 having a selectively closeable access opening 223 formed in a single panel. The selectively closeable access 223 comprises a substantially vertical opening 223*a*, having a length extending from the bottom edge of the fabric panel and to a point spaced apart from the top edge of the fabric panel. In the embodiment shown, access 223 further comprises a substantially horizontal opening, having a length extending across at least a portion of the fabric panel and intersecting the substantially vertical opening. In the embodiment of FIG. 5, the substantially horizontal opening comprises two horizontal portions 223*b* and 223*c*, which each extend from a point spaced from an opposed side edge of the panel toward the center of the panel 222 and intersect at the upper edge of the vertical opening 223*a* to create a substantially T-shaped access. A slide fastener, or zipper, 128 is attached along substantially the entire length of the vertical opening 223*a*. Similarly, a slide fastener 129 is attached along the length of each of the horizontal portions 223*b* and 223*c*. As will be appreciated, the slide fastener 128 that is attached along the vertical opening 223*a* separates from the bottom edge of the panel 222 upwardly, and interlocks from the top edge of the vertical opening 223*a* downwardly. Slide fasteners 129 separate from the intersection with vertical opening 223*a* outwardly toward the opposed side edges of the panel 222 and interlock when an interlocking piece, or tab, is moved inwardly toward the top of the vertical opening 223*a*.

Again and optionally, to protect the slide fasteners from contamination and exposure from the elements, a flap 230 may be affixed to the panel 222 by sewing, adhering, etc. to extend along the length of the vertical opening 223*a*, the flap having one edge attached to the fabric panel and an opposed free edge overlying the slide fastener 128. Similarly, one or more flaps 232 may be affixed along the length of the horizontal openings 223*b* and 223*c* to overly the slide fasters 129 on those horizontal portions.

In the aspect shown in FIG. 5, non-adjustable web straps 124 and fasteners 134 are attached to side portions of the panel 222. Web strap pairs 140 are connected with adjustable fasteners 127 to further secure opening 223*a* for transit. Adjustable fasteners 126 function to take-up the slack in panel 222 in the horizontal direction, while also providing additional load restraint for the cargo in container 12. Again, FIG. 3D illustrates one adjustable fastener 127 that preferably is used. Fastener 127 is comprised of flat hook 502 connected to ring 504 with strap portion 506. Ring 504 is attached with web strap 140 to panel section 122*a*. Hook 502 mates with adjustable cam buckle 508 that is connected to ring 510 with strap portion 512. Ring 510 is attached with strap 142 to panel section 122*b*. Non-adjustable straps 124 with fasteners 134, as shown in FIGS. 3A and 3B, are attached along the bottom and side portions of panels 122*a* and 122*b*, and straps 125 with adjustable fasteners 136 are attached along the top portion of panels 122*a* and 122*b*. Adjustable fasteners 136 function to take-up slack in the vertical direction and apply additional load restraint for the cargo in container 12.

Figure 6:
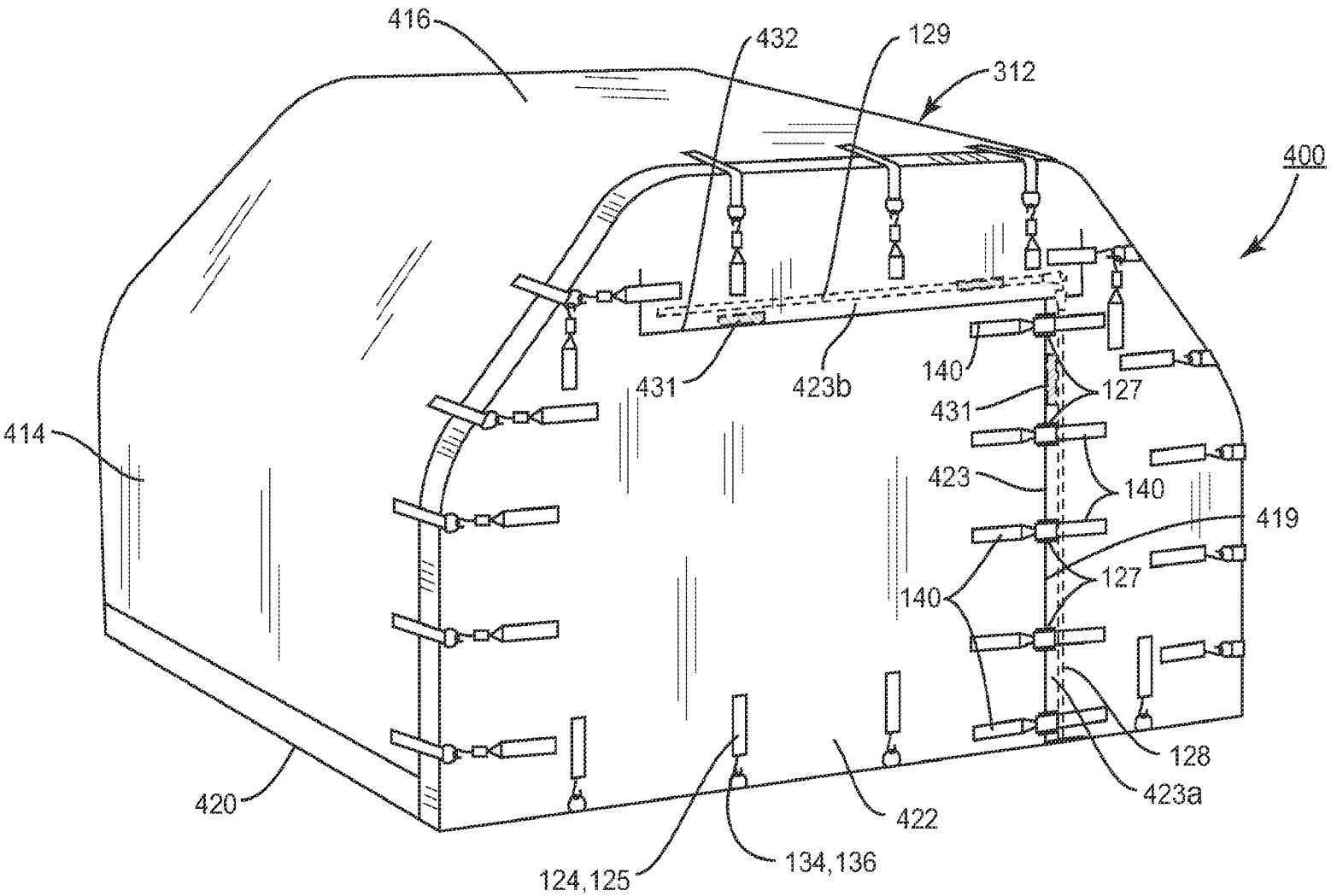
FIG. 6 is a front perspective view of an alternate closure constructed according to another aspect of the present invention for a cargo container.

Alternatively, as shown in FIG. 6, a fabric closure 400 for a cargo container 312, may be formed in the same manner as described above and shown in FIG. 5, except that the access opening 423 is configured differently. As shown in FIG. 6, the single panel 422 also has a selectively closeable access opening 423. Similar in construction to panel 222 in FIG. 5, the selectively closeable access 423 comprises a substantially vertical opening 423*a*, having a length extending from the bottom edge of the fabric panel to a point spaced apart from the top edge of the fabric panel. Access 423 also further comprises a substantially horizontal opening, having a length extending across at least a portion of the fabric panel and intersecting the substantially vertical opening; however, the substantially horizontal opening comprises only a single openable section 423*b*, which extends from a point spaced apart from one of the opposed side edges of the fabric panel 323 and terminates at the intersection with the substantially vertical opening. Thus, the selectively closeable access has an inverted L-shape, depending upon whether the substantially horizontal opening 423*b* extends from the left side (as viewed from the front of panel 423) or the rights side (as viewed from the front of panel 423). Again, a slide fastener, or zipper, 128 is attached along substantially the entire length of the vertical opening 423*a*, and a slide fastener 129 is attached along the length of the horizontal portions 423*b*. Again, the slide fastener 128 that is attached along the vertical opening 423*a* may separate from the bottom edge of the panel 422 upwardly, and interlock from the top edge of the vertical opening 423*a* downwardly. Again, slide fasteners 129 separate from the intersection with vertical opening 423*a* outwardly toward the opposed side edges of the panel 422 and interlock when the interlocking piece, or tab, is moved inwardly toward the top of the vertical opening 423*a*.

Again, optionally, to protect the slide fasteners from contamination and exposure from the elements, a flap 420 may be affixed to the panel 422 by sewing, adhering, etc. to extend along the length of the vertical opening 423*a*, the flap having one edge attached to the fabric panel and an opposed free edge overlying the slide fastener 125. Similarly, one or more flaps 329 may be affixed along the length of the horizontal opening 423*b* to overly and protect the slide faster 127 on that horizontal portion. To further protect the slide fasteners 128 and 129 from contaminants and environmental exposure, the flaps 420 and 432 may be secured to panel 422 with a hook and look fastener, such as VELCRO® 431.

Similar to the previous embodiments, non-adjustable web straps 124 and fasteners 134 or web straps 126 with adjustable fasteners 136 may be attached to spaced apart locations about the bottom of the panel 422 for secure attachment, and adjustment, as desired of the enclosure 400 to the bottom of the cargo container 312. Again, for addition strength and load restraint, web strap pairs 140 may be connected with adjustable fasteners 128 to further secure opening 423*a* for transit.

Figure 7:
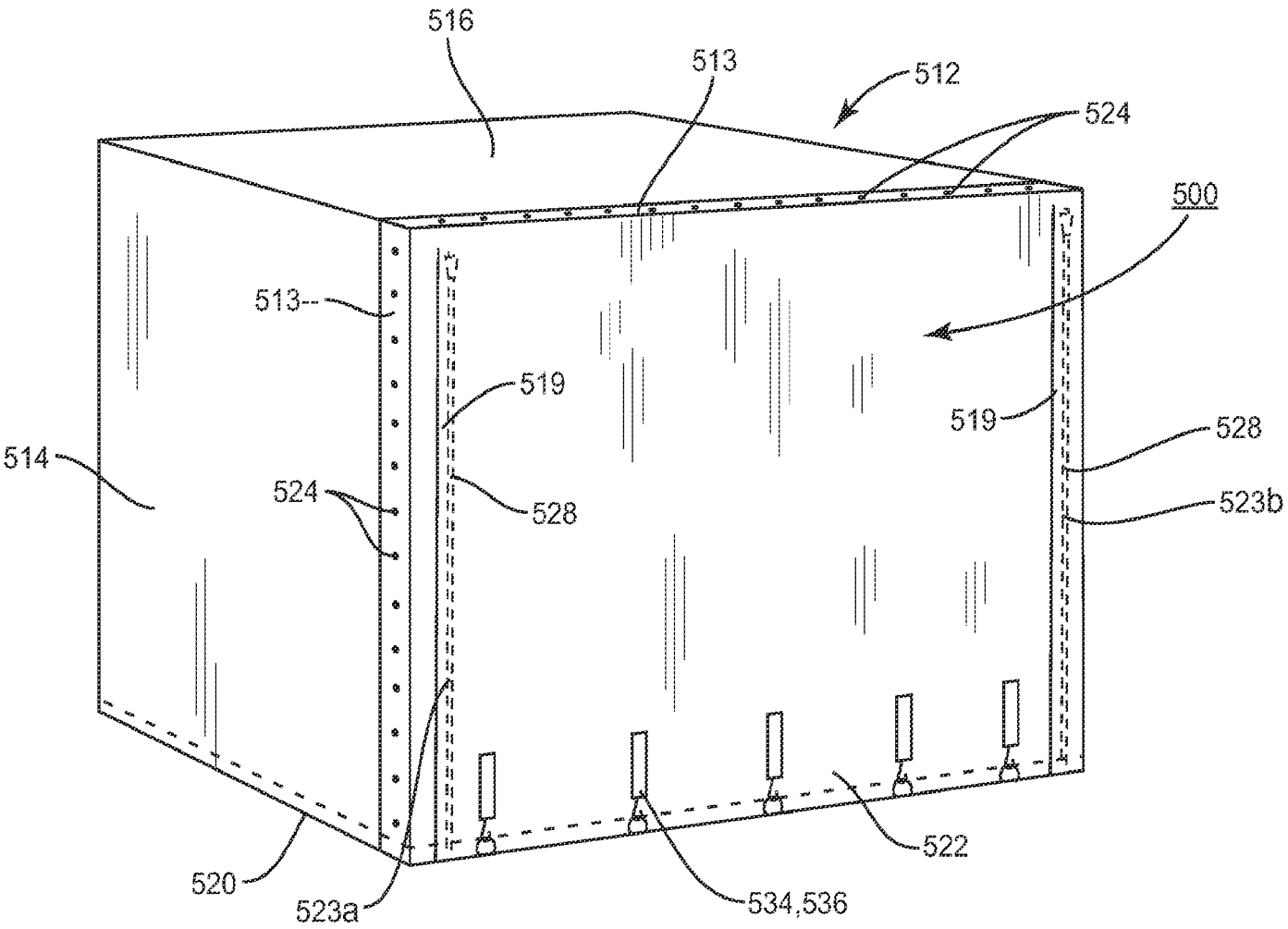
FIG. 7 is a front perspective view of another alternate closure constructed according to another aspect of the present invention for a smaller cargo container.

Turning lastly to FIGS. 7-17, other aspects of the present invention are shown. As shown in FIG. 7, another more regular box-shaped cargo container type 512, with sidewalls 514, top 516, and bottom 520, is illustrated having a fabric closure member 500 over an open end. The fabric closure member 500 also is formed of the same fabric described above and comprising cut and puncture resistant long chain polyethylene fibers/yarns. The fabric closure member 500 comprises edge portions 513 overlapping the edges of the cargo container 512, the edge portions in this embodiment being secured about the perimeter of the cargo container 512 by spaced rivets 524, instead of spaced fasteners. The bottom edge of the closure member 500 should be secured during shipment either by straps 534 and adjustable fasteners 536, as shown, or by some other conventional fastening means.

In the aspect shown in FIG. 7, the closure may be applied to the smaller type of containers. As illustrated the single panel 522 includes a selectively closeable access which comprises two substantially vertical openings 523*a* and 523*b* adjacent the opposite sides, each having a length extending from the bottom edge of the fabric panel 522 to a point adjacent the top edge of the fabric panel. The term "adjacent," as herein used, means that the upper extent of the vertical openings should be sufficiently near the top that, when opened, the cover may be lifted up and out of the way permitting workable access to the interior of the cargo container. Also the vertical opening should be close to the sides for the same purposes. A slide fastener, or zipper, 528 is attached along substantially the entire length of each vertical opening 523*a*, 523*b*. The slide fasteners 528 that are attached along the vertical openings 523*a*, 523*b* may separate from the bottom edge of the panel 522 as the slide is moved upwardly, and interlock from the top edge of the vertical openings as the slide is moved downwardly.

Again, optionally, to protect the slide fasteners from contamination and exposure from the elements, flaps 519 may be affixed to the panel 522 by sewing, adhering, etc. to extend along the length of the vertical openings 523*a*, 523*b*, each flap having one edge attached to the fabric panel 522 and an opposed free edge overlying its respective slide fastener 528. Also, again, to further protect the slide fasteners 528 from contaminants and environmental exposure, the flaps 519 may be secured to panel 522 with a hook and look fastener material, such as VELCRO® (not shown).

As further illustrated in FIG. 8, many air cargo containers are now designed to load luggage, freight, and mail in larger aircraft, particularly in the lower deck area. In this regard, the cargo containers are configured similar to the shape of the aircraft. Some (LD1's-LD3's) are half-width and some (LD6) are full width. While the ensuing description is directed to the half-width configuration, the same concepts apply to full width configurations.

As can be seen in FIG. 8, the LD1-LD3 containers 600 are generally rectangular with an offset 602 designed to more closely follow the outline of the lower half of the larger aircraft. The offset portion 602 is for the storage and transportation of smaller or more irregular shaped items. As can be seen when a mating container is placed next to one container 600 (FIG. 8) the combined shape resembles the lower deck area of the larger aircraft. While the ensuing description in FIGS. 8-14 are directed to, for example, a "left-half" container, the same concepts could apply to a right-hand container, except in reverse (mirror image). Currently right hand containers are simply left hand containers reversed with the cover on the opposite side. There are no "right hand" containers being manufactured, but in the future it could happen.

Containers 600 have a top wall 604, a vertical upper side wall portion 606, an angled lower side wall portion 608, a bottom (not shown), an opposite flat side wall (not shown), and a rear wall (not shown). In addition the offset portion 602 includes a front wall 610, which helps to complete the formation of the offset portion 602 therebehind. All of the aforesaid walls 604, 606, 610 and the other side, rear and bottom walls not shown are generally formed of aluminum, aluminum/Lexan composite, or some other light weight material such as a composite. The front edge of top wall 604, the inner edge of offset portion 602, the front edge of the other side wall and the front edge of the bottom wall form a rectangular opening which is covered by a generally rectangular closure member 650 formed from the same type of material as closure member 122.

The closure member 650 includes a pair of spaced vertical openings 652, 654 extending from a bottom edge 651 to a point adjacent to, but spaced slightly from the edge of top wall 604. The openings are very near the front edge of the other side wall and inner edge of offset portion 604. A slide fastener 660 extends along the adjacent edges of each of the vertical openings 652, 654. Again the slide fasteners 660 should be at least about 10 gauge as described with respect to slide fastener 128.

Figure 21:
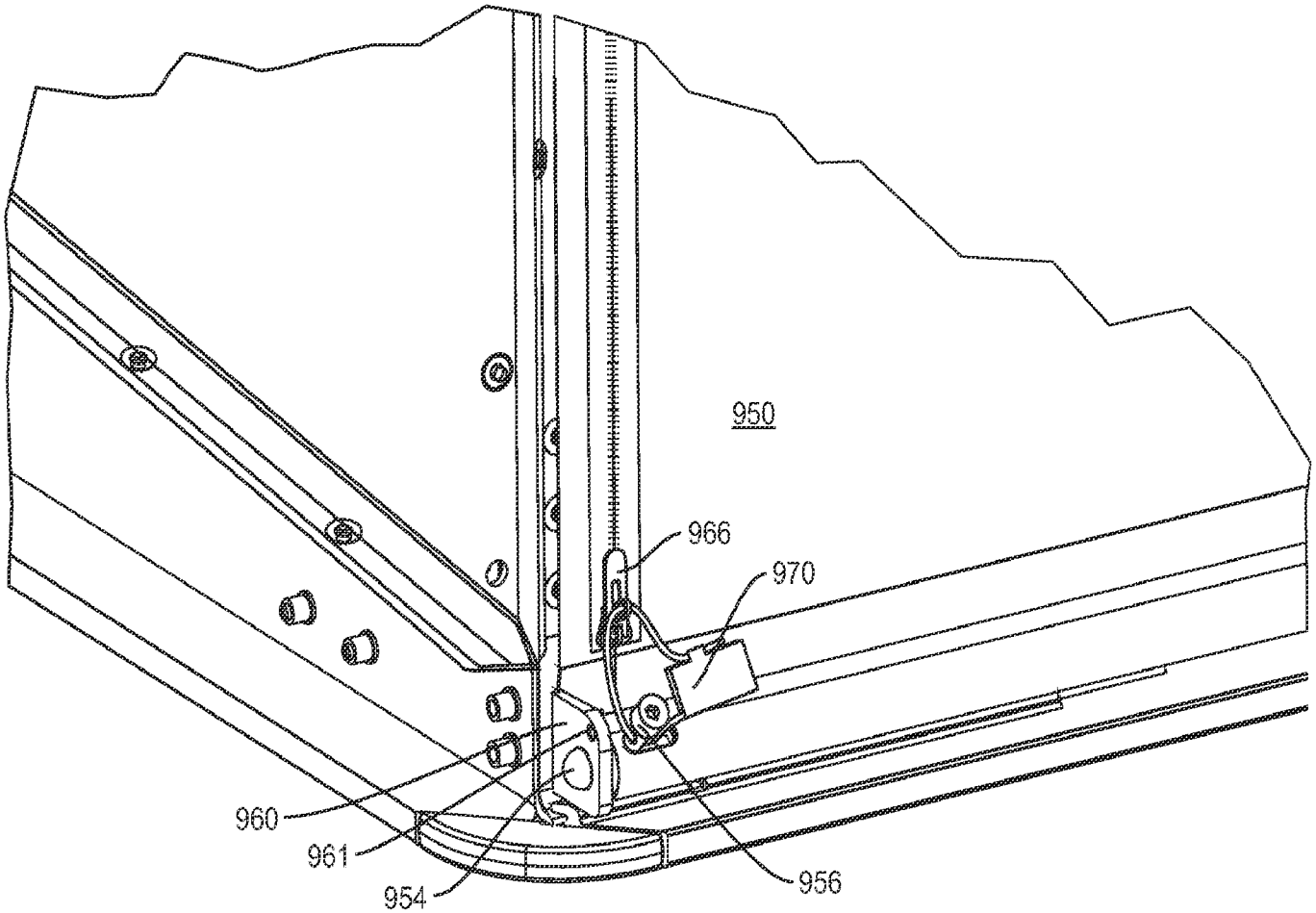

Slide fasteners 660 may be of a conventional type where locking of the closure member is not required. However, the slide fasteners may be of the locking type as illustrated by zipper slide 666 (FIG. 14) and zipper 966 (FIG. 21). These zipper slides 666 include a tab 674 and a loop 676. When the tab 674 is lifted upwardly (FIG. 14) the zipper slide is locked and cannot be moved. A loop 676 extends through the tab 674, and when wire 668 is inserted therethrough, the tab cannot be lowered. Such zipper slides are available as #15 gauge, Bank Bag Pinlock from Lenzip Manufacturing Corporation of Rolling Meadows, Ill.

The closure member 650 may be provided with a hem 655, 656, 657 along the top and both sides through which metal strips extend. Holes are drilled through the metal strip at spaced points and corresponding openings provided in the fabric in both folds of the hem. Rivets then attach the sides and top to the side walls. The bottom can be left unattached as the attached edges of the zipper will cause the closure member 650 to stay in the closed position.

Figure 9:
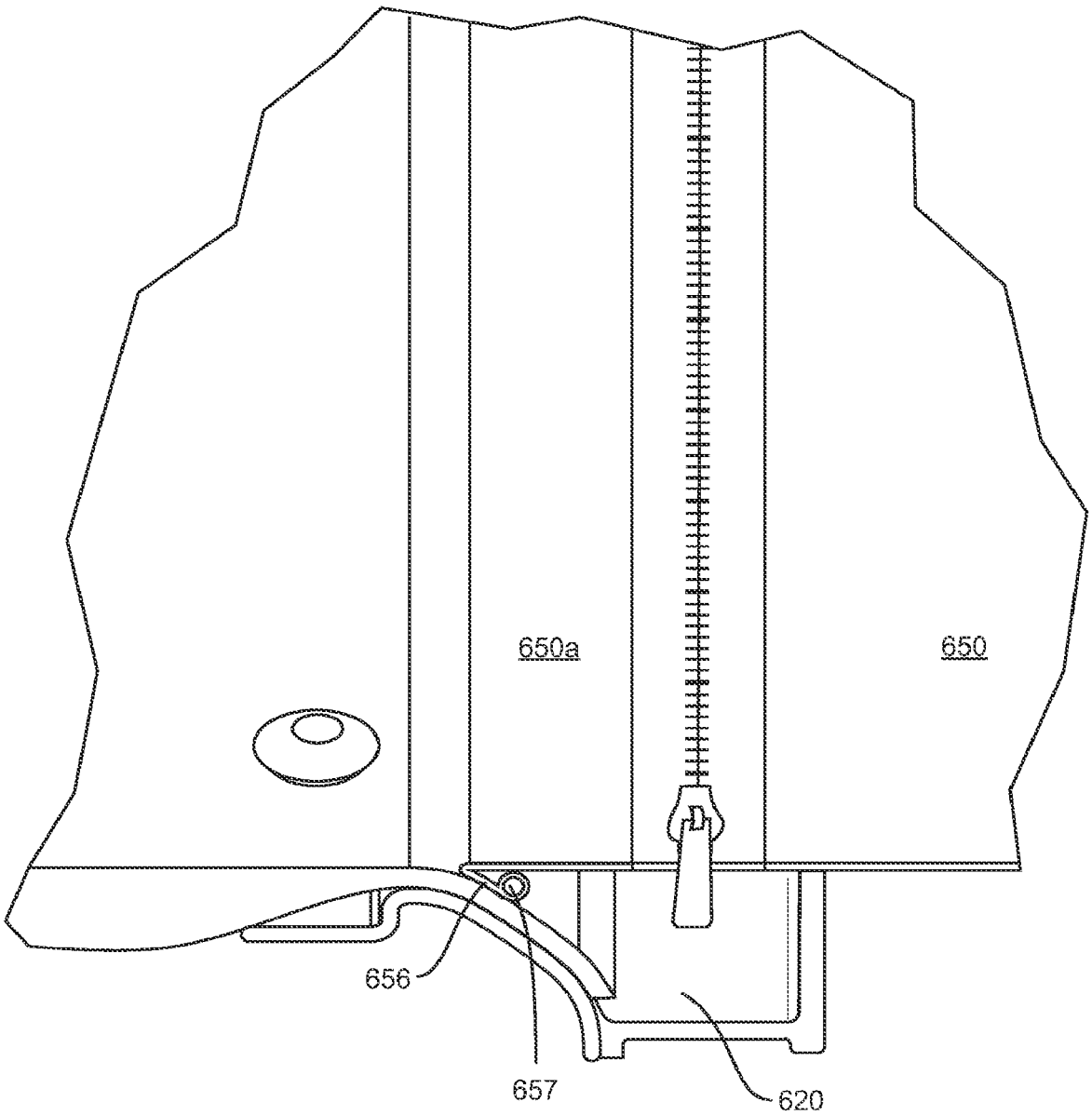
FIG. 9 is a partial front perspective view of the area where the lower left portion of the closure member attaches to the front wall of the offset portion.
Figure 10:
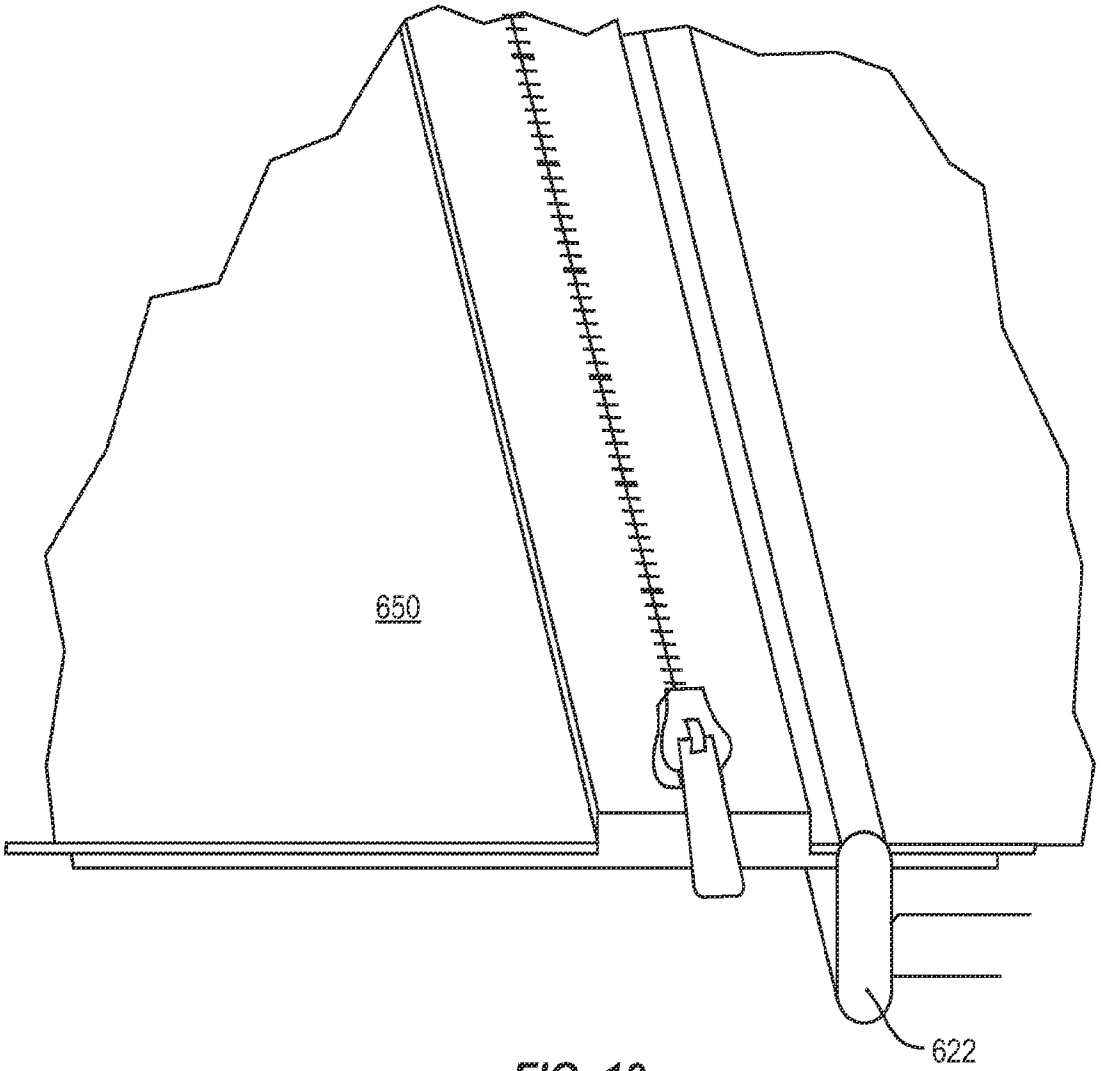
FIG. 10 is a partial front perspective view of the area where the lower right portion of the closure member attaches to the front edge of the other side wall.
Figure 11:
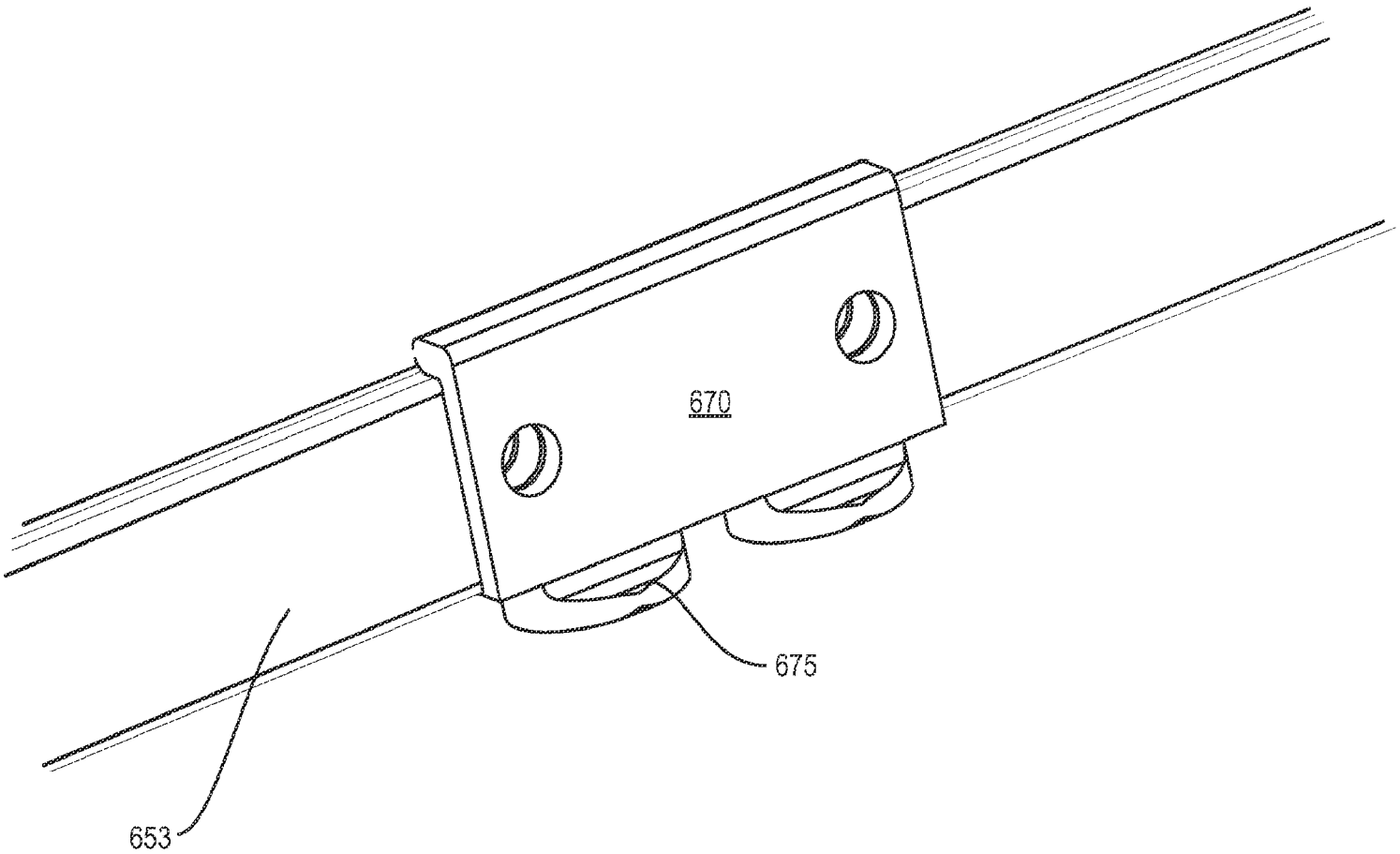
FIG. 11 is a front perspective view of a portion of the lower edge of the closure member with a cleat attached thereto.
Figure 12:
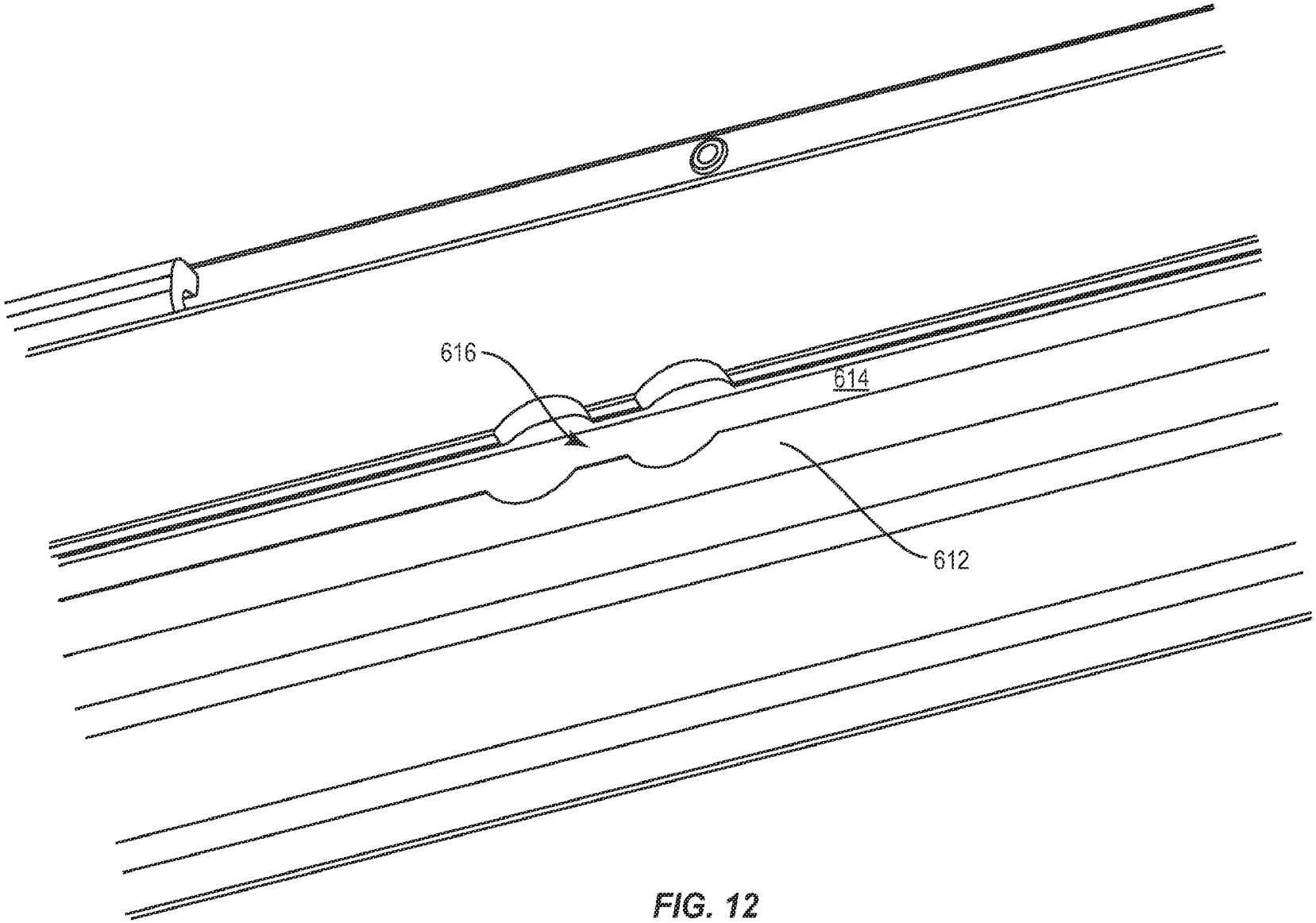
FIG. 12 is a top front perspective view of a portion of the lower T-slotted rail illustrating the two bores therein.
Figure 13:
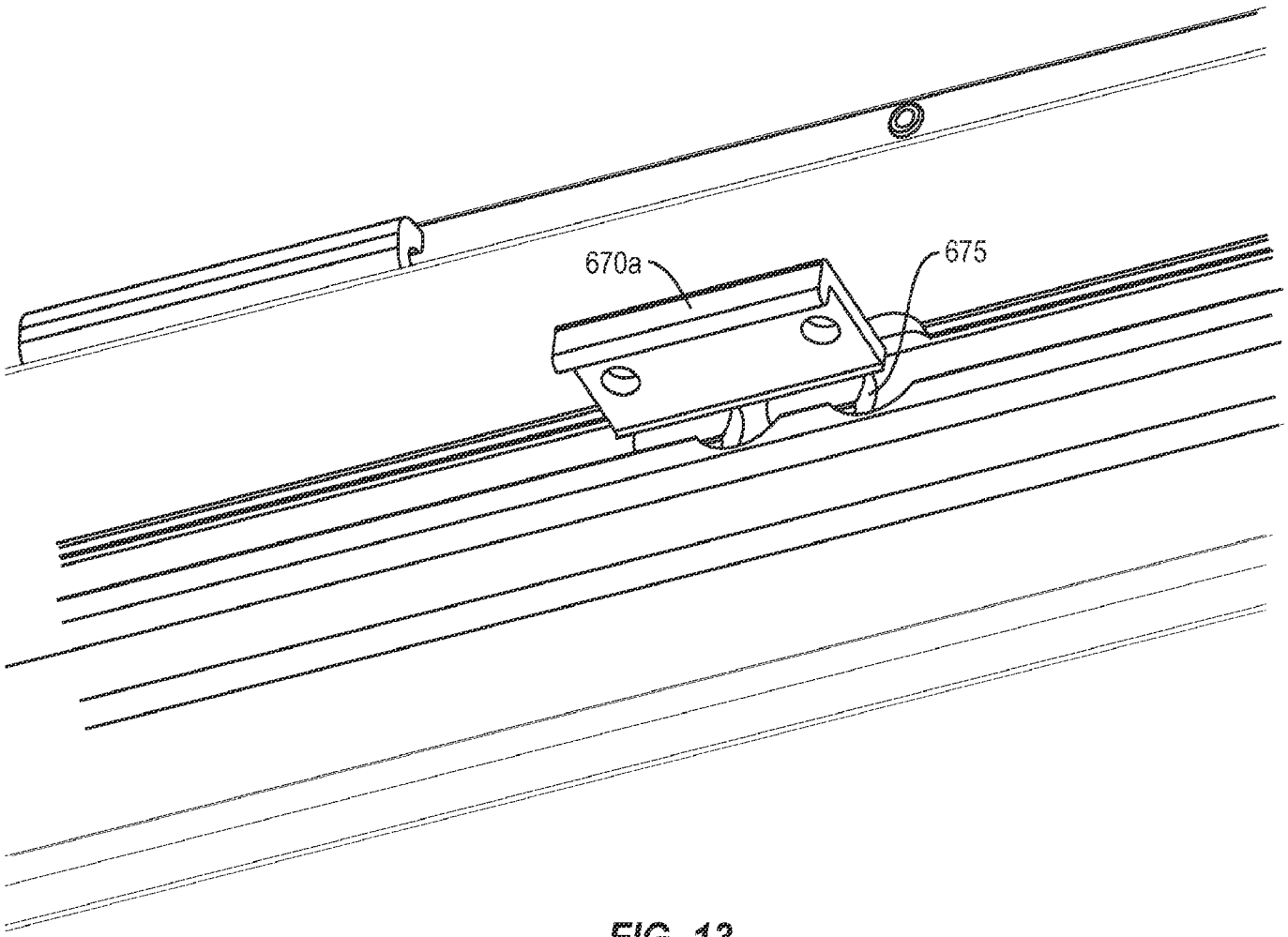
FIG. 13 is a perspective view illustrating the manner in which the cleats of FIG. 11 engage the T-slotted rail of FIG. 12.

According to another aspect, the other side wall and the inner edge of offset portion 604 may be provided with extrusions 620, 622 as illustrated in FIGS. 9 and 10. All edges of the closure member 650 including the narrow edge 650*a* of fabric adjacent the side of the slide fastener 660, may include a hem 656 with a cord 667 extending through it. Hem 656 and cord 657 are then received in an appropriate type of bracket attached to the extrusion 620 in a manner well known to those of skill in the art. Whatever manner of attaching the closure member to the container edges is used, it is advisable to leave open space behind the slide fastener to prevent damage to the teeth in case of collision by a fork truck or some other moving equipment.

As illustrated in FIGS. 11 through 14 cargo containers of this type generally include a front rail 612 with a T-slot 614 therein. The bottom edge 651 of closure member 650 may be provided with a plurality of cleats, clamps or clips 670 which may be riveted or lock-bolted through the closure member 650 adjacent the bottom edge 651. For reinforcement the bottom edge may be formed by a hem 653 through which a thin strip (¾"×3/16" for example) of fiberglass, aluminum, or other light weight metal extends. The strip distributes the load between the cleats. The cleats 670 are formed of some appropriate strong hard polymeric or metallic material and include a base portion 670*a* and a locking portion 670*b*. The base portion includes a pair of circular members 675 extending downwardly therefrom. The locking portion 670*b* is secured to the base portion 670*a*.

Two or more sets of two bores 616 are provided through the top wall forming the T-slot 614 which receives circular members 675 of cleats 670, which are so sized and shaped as to ride easily in T-slot 614. Once in the track, movement of the cleats 670 along the track in such a manner that the circular members 675 are no longer aligned with the bores 616 will retain the bottom edge of the closure member 650 in place.

Figure 14:
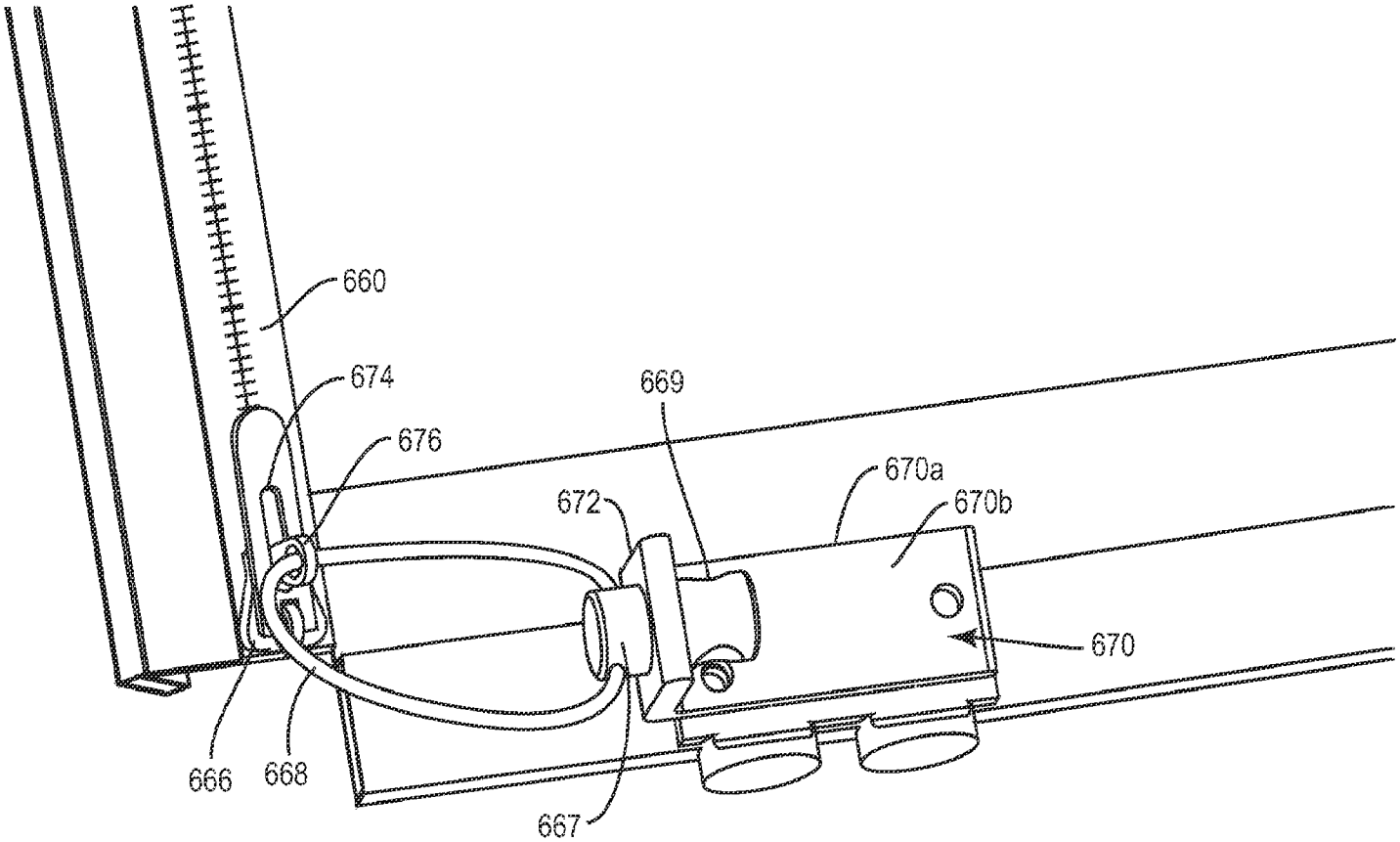
FIG. 14 is a front perspective view of the lower left hand corner of the closure member illustrating the relationship between the slide fastener and the adjacent cleat in preparation for the locking thereof.

As best illustrated in FIG. 14, the cleat 670' nearest slide fastener 660 may be used to provide a security lock for closure member 650. In this regard the slide 666 of slide fastener 660 includes a wire or cord 668 extending through a loop on the slide. Wire 668 has a pin 667 attached thereto, and a hole 669 extends through the opposite end of pin 667. The locking portion 670*b* of cleat 670' includes an L-shaped wall 672 extending outward from the end adjacent the slide fastener. An opening 669 in wall receives pin 667 as illustrated in FIG. 14. When a lock or security tag (not shown) is inserted in opening 669, the cleat 670' is limited in its movement along T-slot 614. When the length of wire 668 is such that cleat 670' cannot be moved back to a position where the circular members 675 are aligned with the bores 616 in the T-slot 614, the closure member is locked down.

Figure 18:
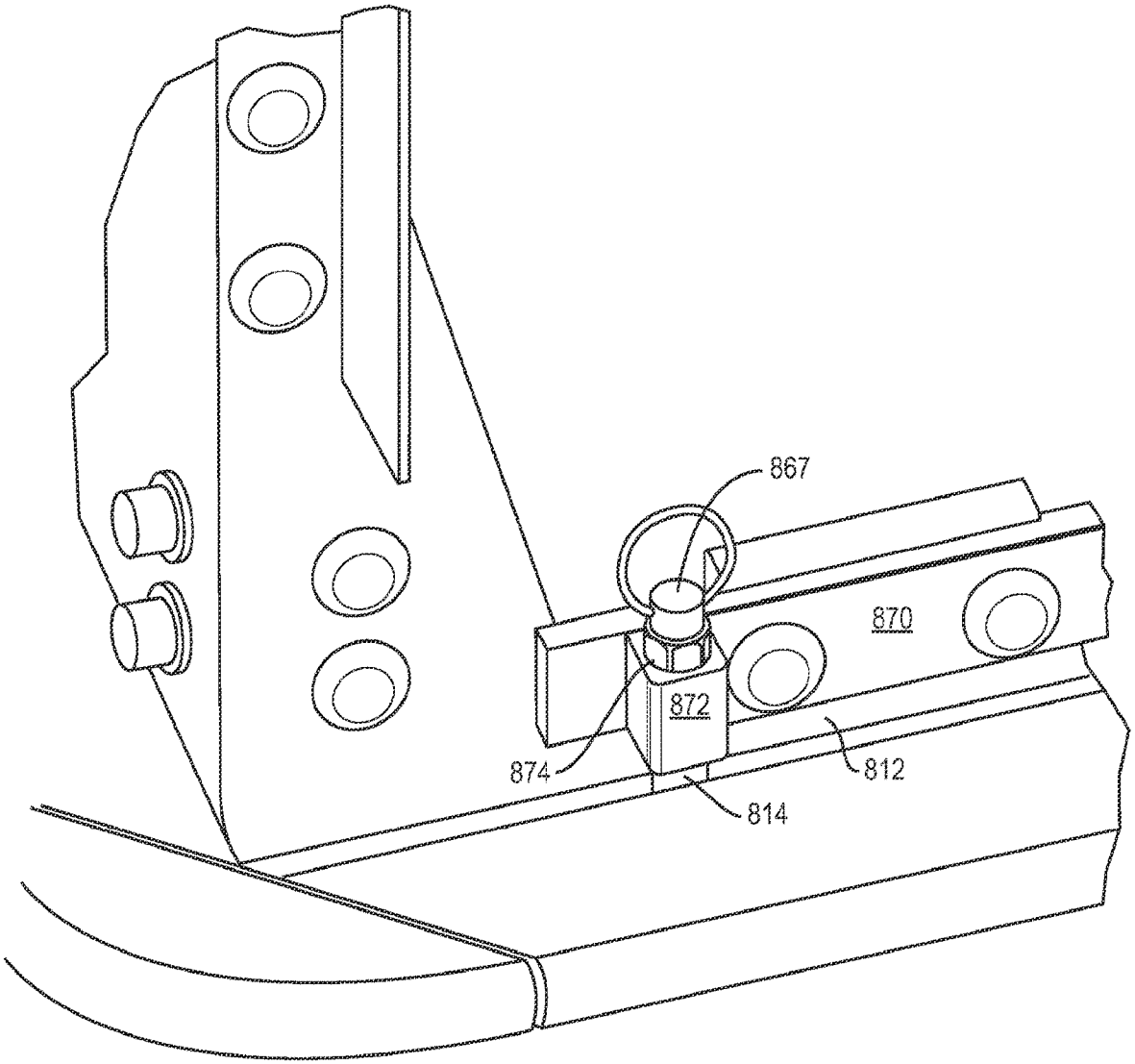
FIGS. 18 and 19 are front perspective views similar to FIG. 14, except showing an alternative closing and locking system.
Figure 19:
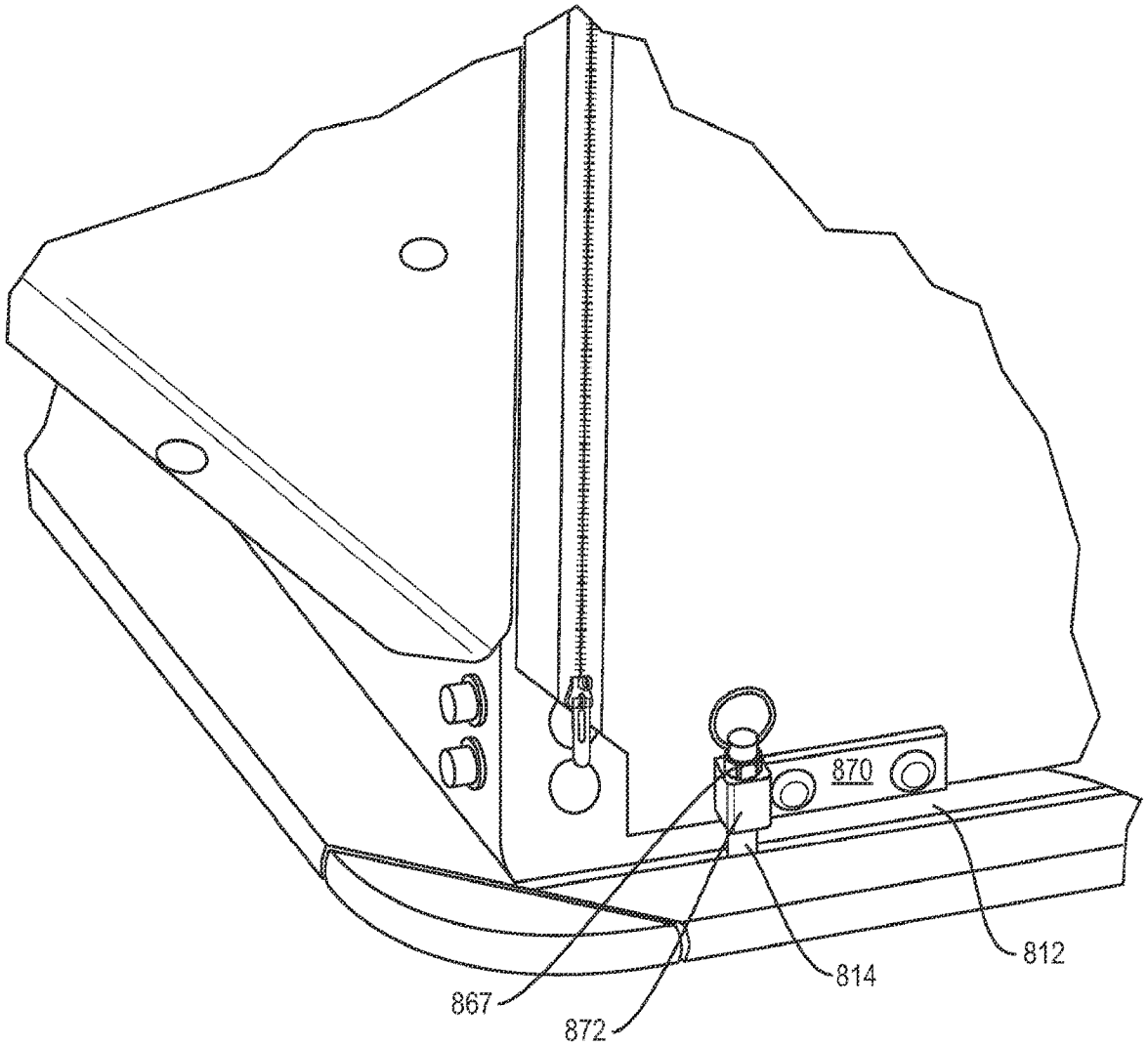

In addition to the closing and locking system illustrated in FIGS. 11-14, other systems may also be employed. For example, as opposed to the wire 668/pine 667 closing and locking arrangement illustrated in FIGS. 18, 19, cleat 870 includes an enlarged boss 872 at the end adjacent the slide fastener. A vertical opening 874 in boss 872 receives spring-loaded detent pin 867. Front rail 812 includes a slot or detent 814 that receives pin 867 when the cleat is inserted in the T-slot and moved to the seated position.

Figure 20:
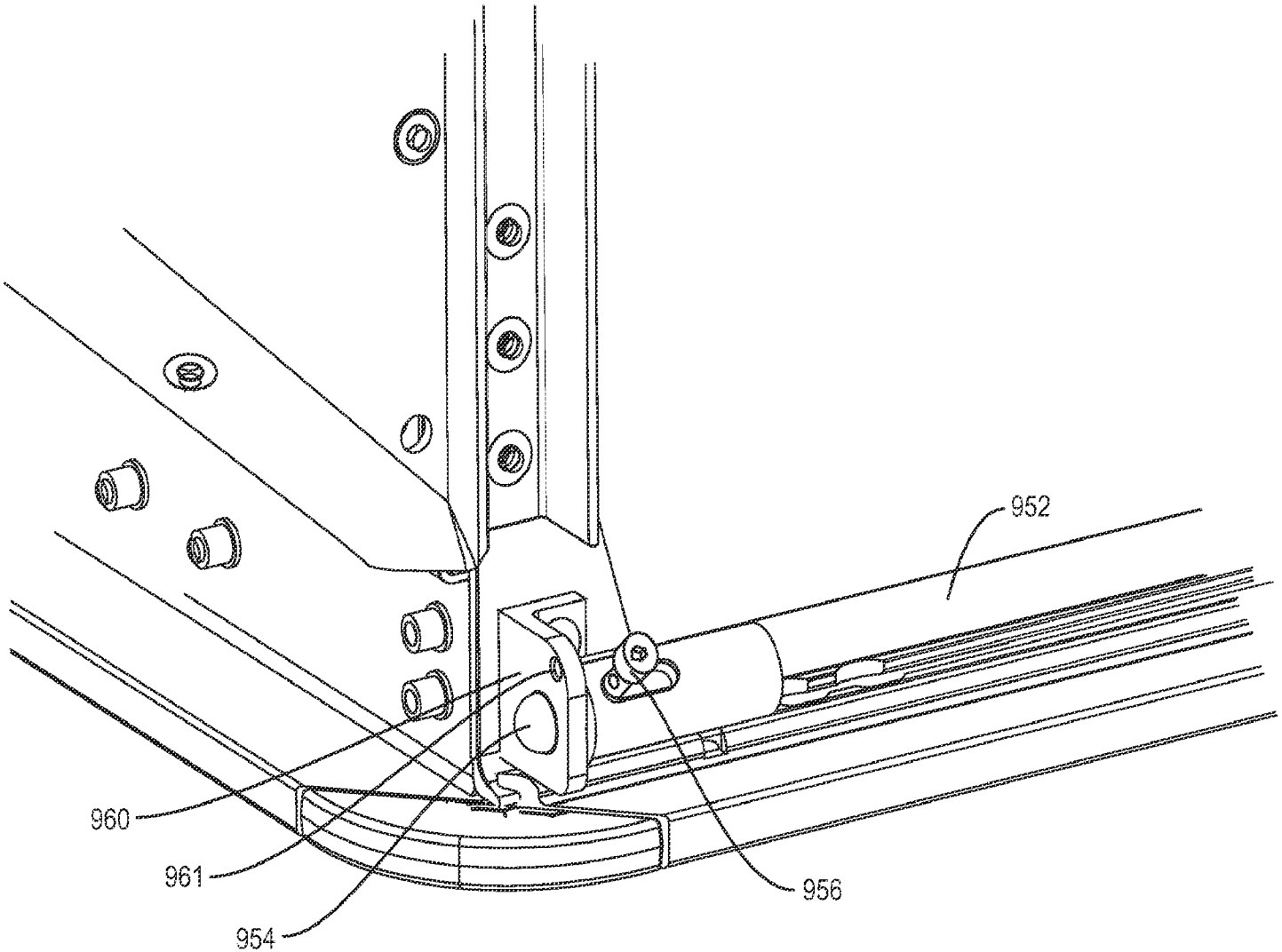
FIGS. 20 and 21 are front perspective views similar to FIGS. 14, 18, and 19, except showing yet another closing and locking system.

FIGS. 20-21 are illustrative for closing/locking systems that do not connect into the bottom T-slot rail. In this approach, as best illustrated in FIG. 20 with the closure member 950 removed, the bottom of the closure member 950 includes a rigid (preferably hollow) bar 952 received into a hem in the fabric itself. The bar is preferably a carbon fiber bar, selected because of its light weight, but could also be aluminum or other material. On one end of this bar is a spring loaded pin 954 that fits into a hole in an angle bracket 960 welded or otherwise attached to the front face of the container frame. The other end (not shown) includes a solid pin that fits into a similar angle bracket.

In this approach pin 954 is released by a spring loaded handle 956, which, when retracted allows pin 950 to be removed from the hole in angle bracket 960. The handle 956 may be provided with a transverse hole 957. A security tag 970 can extend through the hole in handle 956 and either through a hold 961 in bracket 960 or though the hole in zipper tab 976. That way in the former construction the handle 956 cannot be released, and in the latter construction neither the handle 956 nor the zipper 966 can be moved.

As illustrated in FIG. 8, the closure member 650 may be further provided with stiffening strips 658 sewn in or otherwise affixed to one surface of the closure member 650, as for example, in the X pattern shown. Other patterns are also possible. The stiffening strips 658 are preferably of the same fabric as the closure member, although they could be of a different material, even strips of metal or polymeric material. However, forming the strips of fabric formed from high strength yarns, such as high molecular weight polyethylene and the like.

Figure 8A:
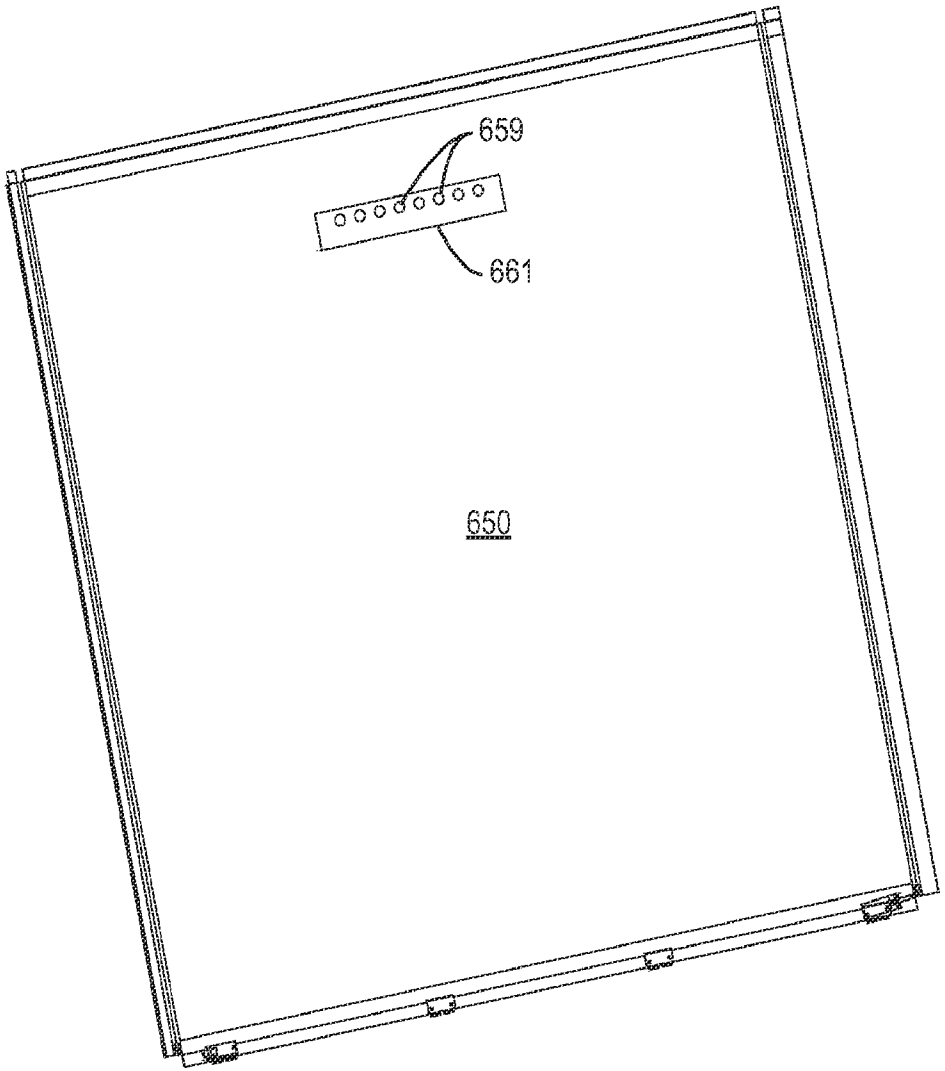
FIGS. 8A and 8B are plan views of the closure of FIG. 8, except showing an alternative concept for venting the curtain.
Figure 8B:
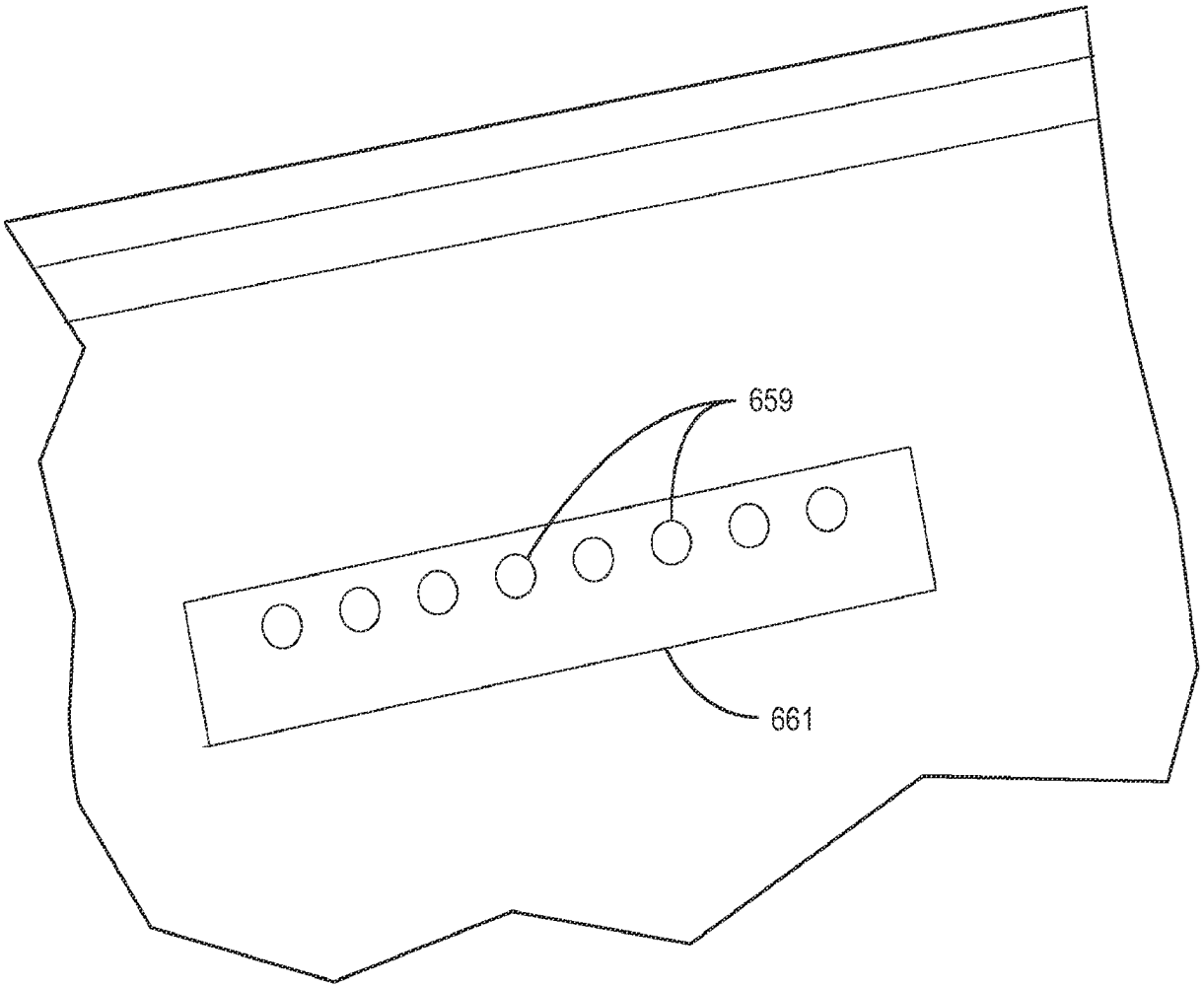

Should venting of the closure member be required to meet pressure equalization requirements of the air cargo container vent holes 659 may be added. See FIGS. 8A and 8B. in addition a cover 661 of, for example, aliphatic polyurethane may be sewn onto the closure member to protect the contents of the container from the weather. The cover 661 is sewn along three sides with the bottom left open for ventilation. If desired, cover 661 is sewn along sides with the bottom left open for ventilation. If desired, cover 661 may be of clear material to prevent cutting or damage of the closure member fabric from remaining undetected.

Figure 15:
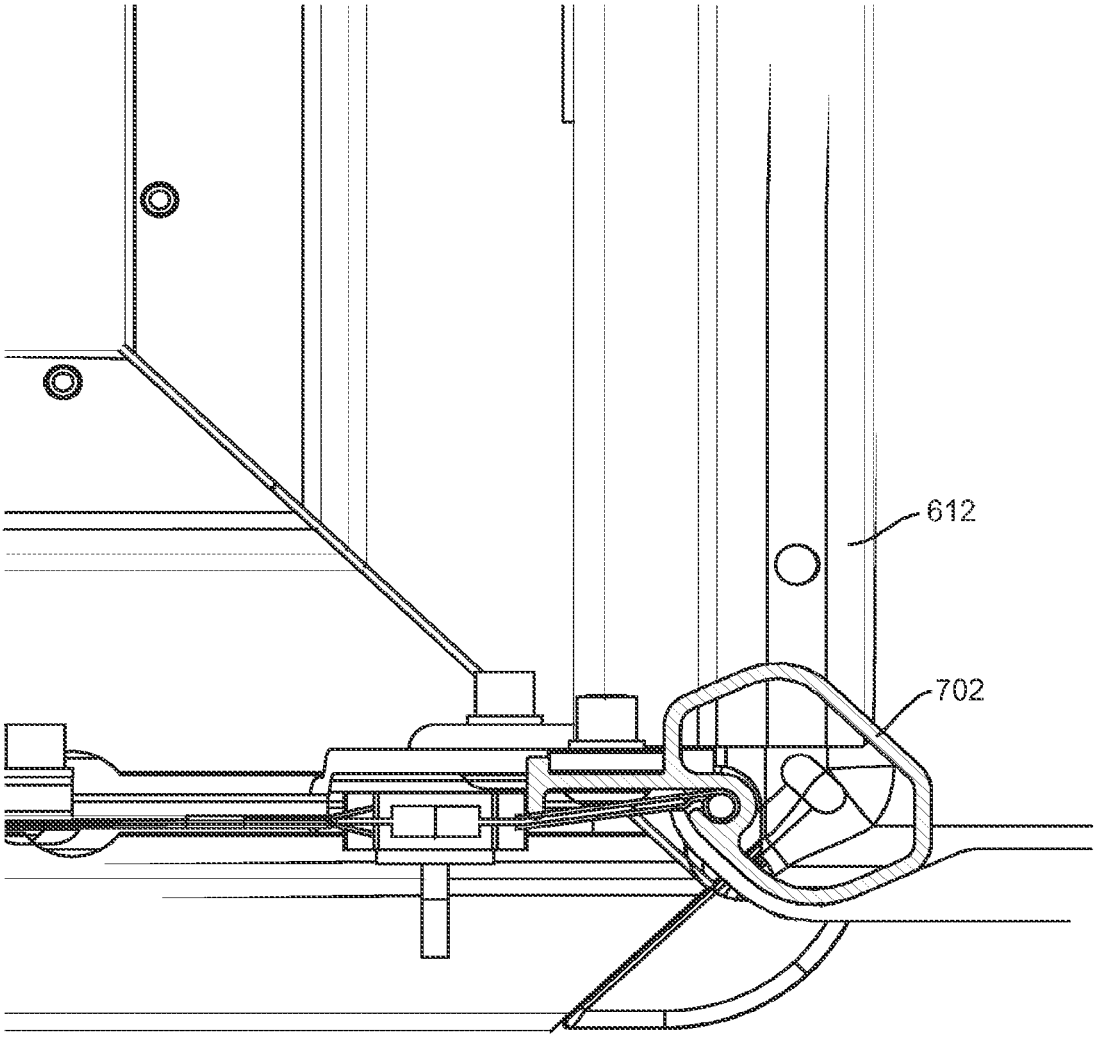
FIGS. 15-17 are sectional views of new designs for the left side, right side and top extrusions respectively.
Figure 16:
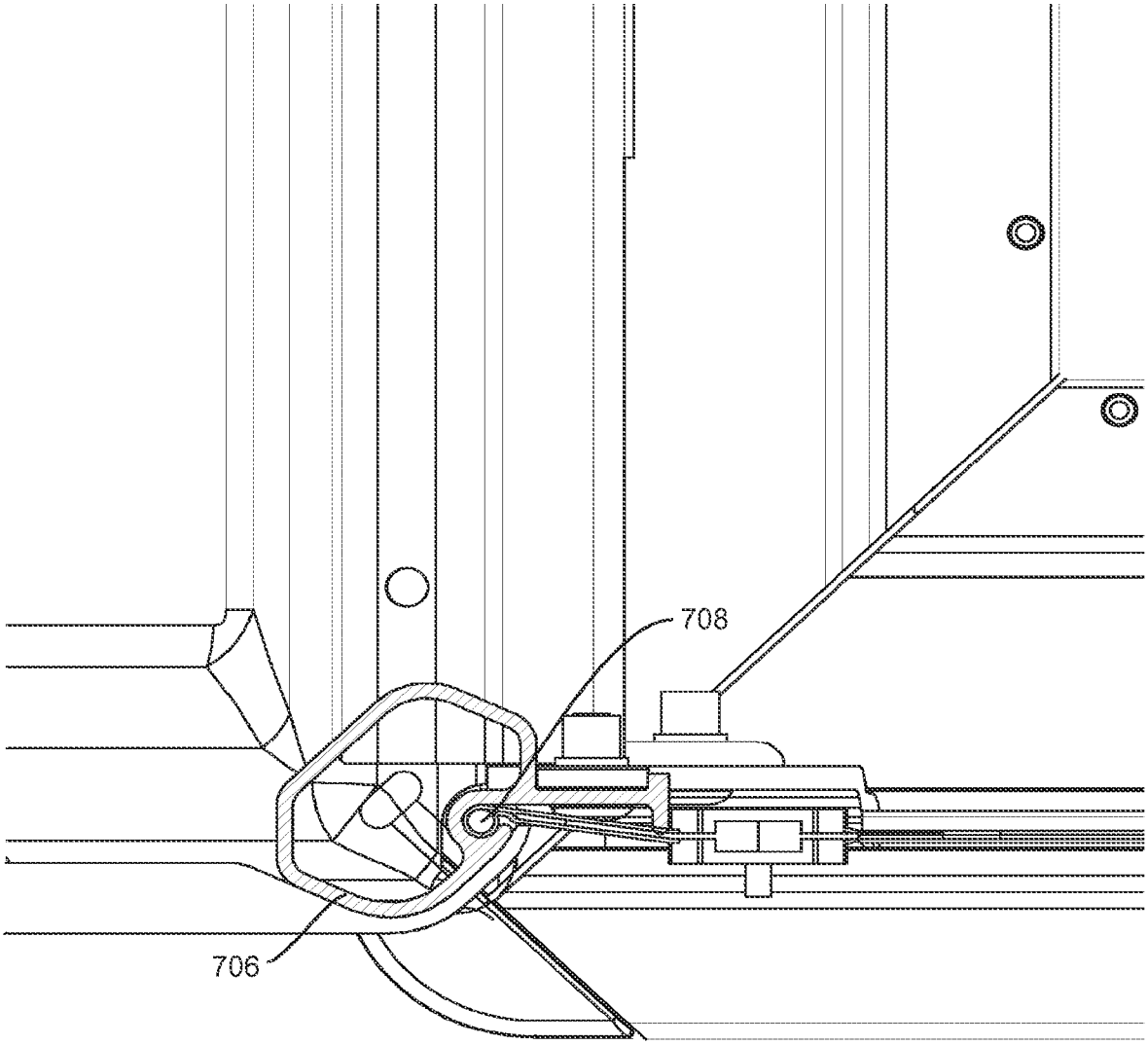
Figure 17:
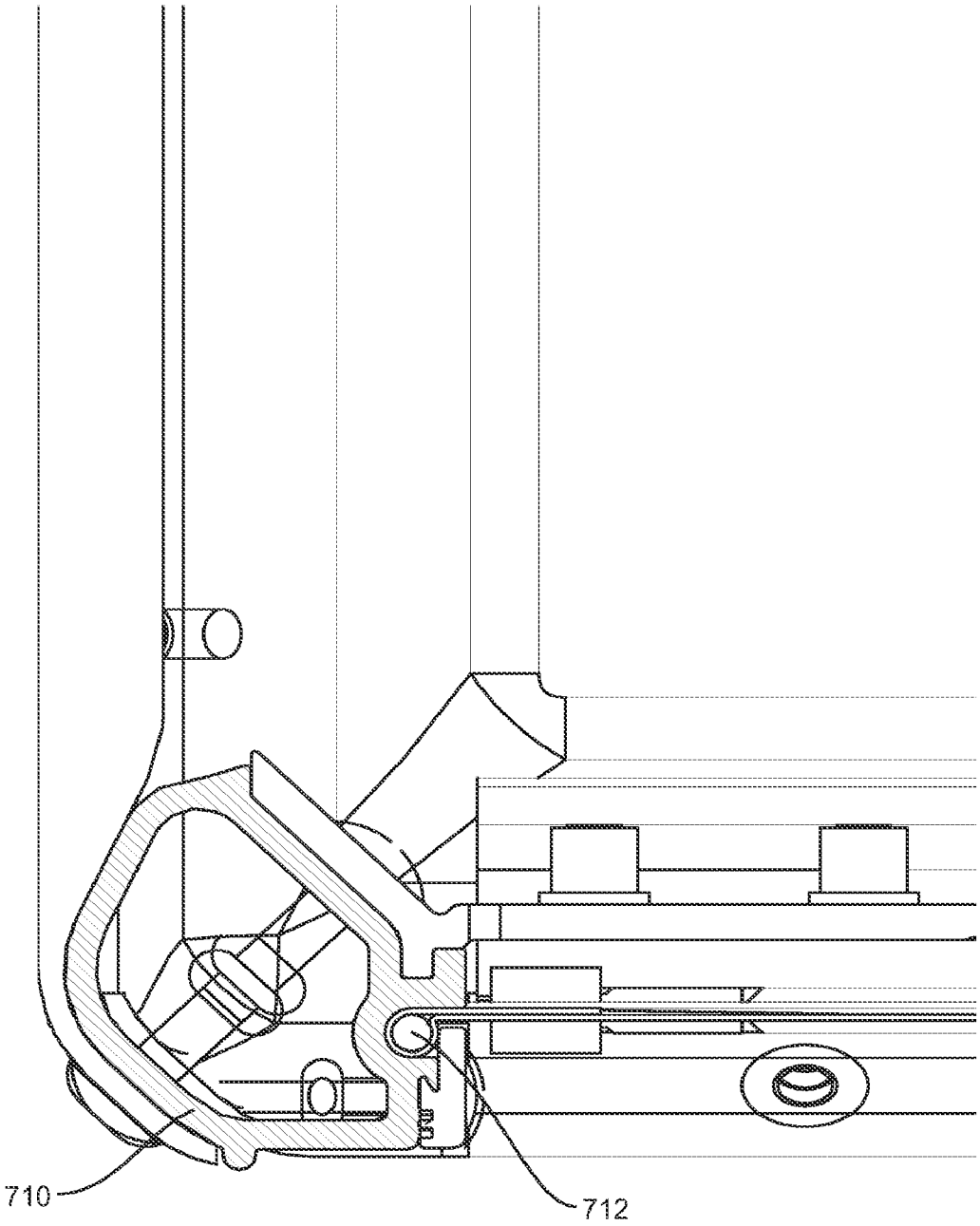

FIGS. 15 through 17 illustrate an alternative design for the side and top edge extrusions for the cargo container, which provide for the reception of the hem/cord edge for the closure member 650 described hereinabove. FIG. 15 shows a cross section of right-hand extrusion member 702 which is welded or otherwise affixed to the front edge of the other side wall shown here as 612. Extrusion 702 includes a generally circular opening 704 which receives and holds the hem/cord edge of closure member 650. In the same manner, FIG. 16 illustrates a cross-section of left-hand extrusion member 706 which is welded or otherwise affixed to the inner edge of the offset portion 602. Again extrusion member 706 includes the generally circular opening 708 which holds the adjacent hem/cord edge of closure member 650. At the top FIG. 17 illustrates a cross-section of the top extrusion member 710 which is welded or otherwise affixed to front edge of top wall 604 and includes circular opening 712 which holds the adjacent hem/cord edge at the top of closure member 650. These extrusions 702, 706, 710 may be provided to owners of existing cargo containers as a retrofit kit, or they may be built into new containers.

Certain modifications and improvements will occur to those skilled in the art upon a reading of the foregoing description. It should be understood that all such modifications and improvements have been deleted herein for the sake of conciseness and readability but are properly within the scope of the following claims.

The invention claimed is:

1. A fabric closure for the open end of cargo containers of the type needing secure closure and having a plurality of side walls, a top, a bottom, and at least one open end, said fabric closure comprising:

(a) a cut and puncture-resistant, substantially waterproof, fabric panel formed primarily of high tenacity fibers having a tenacity greater than about 20 grams/denier, the fabric panel having top and bottom edges and opposed side edges, wherein the top, bottom, and side edges of the fabric panel are attachable to the container side, top, and bottom walls adjacent the open end; and (b) a selectively closable access opening formed in the fabric panel comprising:

(i) a pair of spaced substantially vertical openings in the fabric panel, each adjacent one of the opposed side edges thereof, and each extending from the bottom edge of the fabric panel to a point adjacent the top; and (ii) a slide fastener attached along adjacent edges of the length of each substantially vertical opening;

wherein the fabric panel, when the openings are closed by the slide fasteners, prevents passage of cargo items which may be stowed in the container, yet when the slide fasteners are moved to the open position, the fabric panel may be folded up and out of the way to permit workable access to the interior, wherein the vertical openings are so placed on the fabric panel that each vertical opening lies adjacent one of the side walls of the container when the fabric panel is attached thereto, each slide fastener comprising one side attached to a narrow section of the fabric panel which is, in turn, attachable to the side wall and the other side of the slide fastener attached to the edge of a main portion of the fabric panel between the vertical openings, a slide selectively joining each side of the slide fastener, and wherein at least one bottom fastener is attached to the bottom edge of the fabric panel, the at least one bottom fastener configured to secure the bottom edge of the main portion of the fabric panel to the container and configured to lock a respective one of the slide fasteners in the closed position.

2. The fabric closure of claim 1, wherein the fabric is formed primarily from ultra high molecular weight polyethylene fibers.

3. The fabric closure of claim 2, wherein the fabric panel is woven, and further comprising a coating applied to the fabric panel.

4. The fabric closure of claim 1, wherein the fabric panel is woven and comprises a coating, the coating comprises:

(a) a first thermoplastic film applied directly on at least one side of the fabric, the thermoplastic film comprising ethylene vinyl acetate and having a thickness of between about 2 and 8 mils; and (b) a second, outer thermoplastic film applied over the first thermoplastic film, the second thermoplastic film being a high density polyethylene or a low density polyethylene and having a thickness of between 1.5 and 20 mils.

5. The fabric closure of claim 1, wherein the high tenacity fibers are selected from the group consisting of high molecular weight polyethylene, high molecular weight polypropylene, high molecular weight aramids including para-aramids, high molecular weight polybenzoxazole (PBO), high molecular weight polybenzothiazole (PBT), high molecular weight polyvinyl alcohols, high molecular weight polyacrylonitrile, liquid pistol co-polyester, basalt, and combinations of blends thereof.

6. The fabric closure of claim 1, wherein the cargo container is of a type in which at least one side wall includes a channel member extending generally vertically along the edge thereof and the fabric panel is so connected to the side wall that the slide fastener overlies the channel, whereby the slide fastener has a space behind it which protects the slide fastener itself from impact.

7. The fabric closure of claim 1, wherein the fabric panel includes at least two stiffening strips extending diagonally across the surface of the fabric panel to provide a higher shear strength.

8. The fabric closure of claim 7, wherein the stiffening strips are formed of high-strength yarn made with high tenacity fibers having a tenacity greater than 20 grams/denier.

9. The fabric closure of claim 1, further comprising a locking member for attachment between the slide and the at least one bottom fastener for selectively locking the bottom edge of the fabric panel in a closed position adjacent the bottom wall of the cargo container.

10. The fabric closure of claim 1, wherein the fabric panel includes at least one vent hole with a cover member emplaced thereover, the cover member having one edge left open for ventilation.

11. A cargo container and fabric closure, comprising:

(a) a plurality of side walls, a top, a bottom, and at least one open end;

(b) a cut and puncture-resistant, substantially waterproof, fabric panel formed primarily of high tenacity fibers having a tenacity greater than about 20 grams/denier, the fabric panel having top and bottom edges and opposed side edges, wherein the top, bottom, and side edges of the fabric panel are attached to the container side, top, and bottom walls adjacent the open end; and (c) a selectively closeable access opening formed in the fabric panel for access therethrough, comprising:

(i) a pair of spaced, substantially vertical openings in the fabric panel, each adjacent one of the opposed side edges thereof, and each extending from the bottom edge of the fabric panel to a point adjacent the top; and (ii) a slide fastener attached along adjacent edges of the length of each substantially vertical opening;

wherein the fabric panel, when the openings are closed by the slide fasteners prevents passage of cargo items which may be stowed in the container yet when the slide fasteners are moved to the open position, the fabric panel may be folded up and out of the way to permit workable access to the interior, wherein the vertical openings are so placed on the fabric panel that each vertical opening lies adjacent one of the side walls of the container when the fabric panel is attached thereto, each slide fastener comprising one side attached to a narrow section of the fabric panel which is, in turn, attachable to the side wall and the other side of the slide fastener attached to the edge of a main portion of the fabric panel between the vertical openings, a slide selectively joining each side of the slide fastener, and wherein at least one bottom fastener is attached to the bottom edge of the fabric panel, the at least one bottom fastener configured to secure the bottom edge of the main portion of the fabric panel to the container and configured to lock a respective one of the slide fasteners in the closed position.

12. The cargo container of claim 11, wherein the fabric is formed primarily from ultra-high molecular weight polyethylene fibers.

13. The cargo container of claim 11, wherein the fabric panel is woven, and further comprising a coating applied to the fabric panel.

14. The cargo container of claim 12, wherein the fabric panel is woven and comprises a coating, wherein the coating comprises:

(a) a first thermoplastic film applied directly on at least one side of the fabric, the thermoplastic film comprising ethylene vinyl acetate and having a thickness of between about 2 and 8 mils; and (b) a second, outer thermoplastic film applied over the first thermoplastic film, the second thermoplastic film being a high density polyethylene or a low density polyethylene and having a thickness of between about 1.5 and 20 mils.

15. The cargo container of claim 11, wherein the high tenacity fibers are selected from the group consisting of high molecular weight polyethylene, high molecular weight polypropylene, high molecular weight aramids including para-aramids, high molecular weight polybenzoxazole (PBO), high molecular weight polybenzothiazole (PBT), high molecular weight polyvinyl alcohols, high molecular weight polyacrylonitrile, liquid pistol co-polyester, basalt, and combinations or blends thereof.

16. The cargo container of claim 11, wherein the cargo container is of a type in which at least one side wall includes a channel member extending generally vertically along the edge thereof and the fabric panel is so connected to the side wall that the slide fastener overlies the channel, whereby the slide fastener has a space behind it which protects the slide fastener itself from impact.

17. The cargo container of claim 11, wherein the fabric panel includes at least two stiffening strips extending diagonally across the surface of the fabric panel to provide a higher shear strength.

18. The cargo container of claim 11, further comprising a locking member for attachment between the slide and the at least one bottom fastener for selectively locking the bottom edge of the fabric panel in a closed position adjacent the bottom wall of the cargo container.

19. The cargo container of claim 11, wherein the cargo container comprises riveted connection points along the side walls and top at spaced points around at least one open end for riveted connection of the fabric closure thereto.

20. The cargo container of claim 11, wherein the slide fasteners are at least 10 gauge.

21. The cargo container of claim 11, wherein the fabric panel includes at least one vent hole with a cover member emplaced thereover, the cover member having one edge left open for ventilation.

22. The fabric closure of claim 1, wherein the at least one bottom fastener is a single bottom fastener configured to lock each of the slide fasteners in the closed position.

23. The fabric closure of claim 1, wherein the at least one bottom fastener includes a first bottom fastener configured to lock one of the slide fasteners in the closed position and a second bottom fastener configured to lock the other one of the slide fasteners in the closed position.

* * * * *